US005940104A

United States Patent [19]

Karita et al.

[11] Patent Number: 5,940,104

[45] Date of Patent: Aug. 17, 1999

[54] INK JET HEAD HAVING SEALING MEMBER WITH OPENING

[75] Inventors: Seiichiro Karita; Norio Ohkuma, both of Yokohama; Megumi Saito, Kawasaki; Masahiko Higuma, Togane; Teruo Arashima, Kawasaki, all of Japan

[73] Assignee: Canon Kabushiki Kaisha, Tokyo, Japan

[21] Appl. No.: 07/848,847

[22] Filed: Mar. 9, 1992

[30] Foreign Application Priority Data

Mar. 8, 1991 [JP] Japan ..... 3-043666
Mar. 8, 1991 [JP] Japan ..... 3-043667

[51] Int. Cl.[6] ..... B41J 2/175

[52] U.S. Cl. ..... 347/87

[58] Field of Search ..... 346/1.1, 140 R; 428/343, 355; 525/123; 347/44, 87; B41J 2/175

[56] References Cited

U.S. PATENT DOCUMENTS

| | | | |
|---|---|---|---|
| 3,610,765 | 10/1971 | Bok | 346/140.1 X |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,524,104 | 6/1985 | Hagio et al. | 428/343 X |
| 4,558,333 | 12/1985 | Sugitani et al. | 347/65 |
| 4,638,336 | 1/1987 | Hofmann | 347/29 |
| 4,707,714 | 11/1987 | Rosenthal et al. | 347/29 |
| 4,723,129 | 2/1988 | Endo et al. | 347/56 |
| 4,740,796 | 4/1988 | Endo et al. | 347/56 |
| 4,987,186 | 1/1991 | Akiyama et al. | 525/123 X |
| 4,994,824 | 2/1991 | Winslow | 347/87 |
| 5,010,354 | 4/1991 | Cowger et al. | 347/87 |
| 5,040,002 | 8/1991 | Pollacek et al. | 347/87 |
| 5,066,964 | 11/1991 | Fukuda et al. | 347/18 |

FOREIGN PATENT DOCUMENTS

| | | |
|---|---|---|
| 0418828 | 3/1991 | European Pat. Off. . |
| 59-123670 | 7/1984 | Japan . |
| 59-138461 | 8/1984 | Japan . |
| 59-198161 | 11/1984 | Japan . |
| 60-141564 | 7/1985 | Japan . |
| 60-204348 | 10/1985 | Japan . |
| 61-125851 | 6/1986 | Japan . |
| 62-113556 | 5/1987 | Japan . |
| 62-273855 | 11/1987 | Japan . |
| 0000185 | 1/1989 | Japan . |

*Primary Examiner*—David F. Yockey
*Attorney, Agent, or Firm*—Fitzpatrick, Cella, Harper & Scinto

[57] ABSTRACT

A recording head comprises an ink container, an energy generating device for discharging ink from the ink container, an ink discharge section corresponding to the energy generating device and a covering member that covers the ink discharge section and an atmosphere-communicating opening for the ink container, wherein when the recording head is out of recording, a small opening communicating with the atmosphere-communicating opening, or a valve member capable of opening or closing in accordance with an internal pressure change, or an internal pressure change-absorbing member capable of absorbing an internal pressure change by changing its volume is provided on said covering member at a position corresponding to the atmosphere-communicating opening.

3 Claims, 16 Drawing Sheets

FIG. 1A
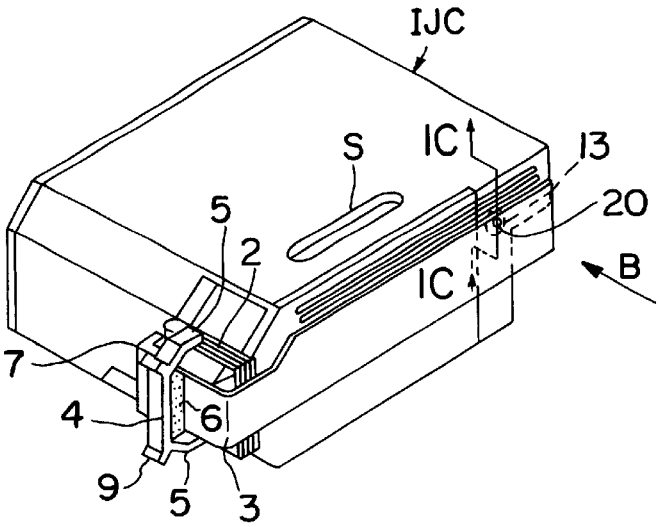
FIG. 1B
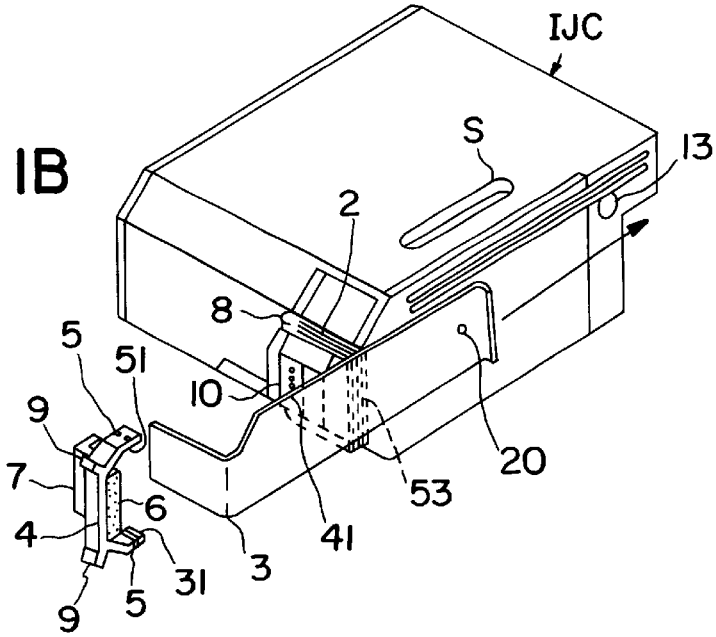
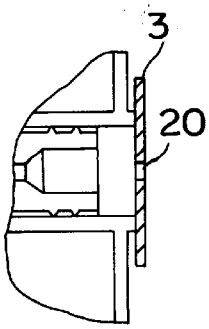
FIG. 1C
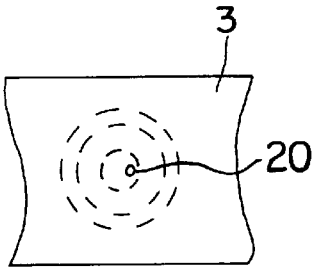
FIG. 1D

INK JET HEAD HAVING SEALING MEMBER WITH OPENING

BACKGROUND OF THE INVENTION

1. Field of the Invention

The present invention relates to an ink jet recording head a method for preserving an ink container, or a recording head integrated with an ink container, and also to a mechanism for preventing ink leakage during an unrecording time or for preventing changes in pressure in an ink container on the whole as preferable uses.

The present invention relates to a recording head or a recording head integrated with an ink tank applicable to a printer, a copying machine, a facsimile, an ink jet recording apparatus to be used as business machines, and a method for preserving the recording head or the recording head integrated with an ink tank, or more particularly to a recording head detachable from the main apparatus.

2. Prior Art

In order to prevent clogging during the transportation or injection failure of an ink, an ink jet recording apparatus is usually provided with a capping device with an ink absorber so as to cover the discharge opening surface, as disclosed in Japanese Patent Application Kokai (Laid-open) No.59-198161. As a result of recent development of a cartridge-type ink jet head integrated with an ink tank, discharge opening surface protecting members without any capping device have been proposed to protect a discharge opening, for example, by providing a cap-like protective member having an ink absorber at the discharge opening, as disclosed in Japanese Patent Application Kokai (Laid-open) No.60-204348, or by using a sealing member based on vinylidene chloride resin as a protective tape for the discharge opening, as disclosed in Japanese Patent Application Kokai (Laid-open) No. 61-125851.

The present applicants proposed to cover the discharge section of a recording head integrated with an ink container and the atmosphere-communicating opening of the ink container section with a sealing tape using a specific adhesive, thereby bringing both of the discharge section and the atmosphere-communicating opening into a tightly closed structure. Ink leakage can be prevented thereby, and peeling of the sealing tape can be easily made when the ink head is used. The proposed covering with a sealing tape is quite practical and effective for preventing ink leakage.

However, the internal pressure in the ink cartridge is elevated due to rapid changes in the temperature of the surrounding circumstance during their transportation, because of the tight closing of the ink cartridge, and consequently ink leakage from other sealed parts is liable to occur. Thus, it is necessary to control elevation of ink tank internal pressure against changes in the surrounding circumstance.

Furthermore, the above-mentioned conventional capping device has such a fear that ink will leak due to vibrations during the normal transportation of printers to foul the printer inside. In case of the cartridge-type ink jet head integrated with an ink tank, the cap-like protective member is very expensive, or ink will fill the protective member to foul the discharge opening or cause clogging or discharge failure. Accordingly, sealing the discharge opening surface with a sealing tape has been studied. In case of the vinylidene chloride resin, the adhesive components have not been fully studied, and thus positioning of the tape to the discharge opening is quite difficult to make and also the workability is not good.

In case of using commercially available tapes from the viewpoint of cost and easy availability, the following disadvantages have been encountered and the commercially available can not be applied to the ink jet head.

The conventional adhesives can be classified into three main groups, i.e., 1) rubber-based adhesives, 2) silicone-based adhesives and 3) acrylic resin-based adhesives. The rubber-based adhesives 1) have a good adhesiveness, but have many unsaturated groups, which lead to chemical denaturing or deterioration. The silicone-based adhesives 2) have less denaturing and a good chemical resistance, but have a low adhesiveness. Tight bonding to articles cannot be obtained. The acrylic resin-based adhesives 3) have less denaturing, and require addition of an adhesive aid such as polyterpene resin, rosin, phenol resin, etc. and thus the peeling strength is high, and the adhesive aid resin dissolve into a water-soluble organic solvent contained in the ink. Furthermore, the acrylic resin of the ordinary acrylic resin-based adhesives contain oligomer components having a relatively low degree of polymerization, which gradually dissolve out to foul the discharge opening surface or the inside. These problems have been clarified by the applicants.

However, the present inventors encountered new problems which were not recognized in the above-mentioned propose. That is, during aircraft transportation there occurred peculiar cases of ink leakage at the positions sealed with the sealing tape due to considerable changes in internal pressure of the ink container or the entire recording head integrated with an ink container at a high temperature in the aircraft. When the adhesion strength of sealing is increased to prevent the ink leakage, tape peeling operation is correspondingly more difficult to make or ink leakage occurs at joints of the assembly of the recording head, or the strength of joints is lowered. These problems are more remarkable when the recording heads are produced at a lower cost to supply recording head at a more economical cost.

SUMMARY OF THE INVENTION

An object of the present invention is to solve the above-mentioned problems of ink leakage from the welded parts during the transportation by controlling an internal pressure increase in the ink container when the recording head is out of the recording.

Another object of the present invention is to solve the above-mentioned problems of ink leakage while facilitating peeling operation of an adhesive member from a recording head.

Still another object of the present invention is to provide a method for preserving various articles stably for a long time and attaining desired uses of the articles immediately without any influence of a remaining solvent or adhesive from the adhesive section when the articles are used and also to provide a container for the preservation based on the method.

According to a first aspect of the present invention, there is provided a recording head, which comprises an ink container, an energy generating device for discharging ink from the ink container, an ink discharge section corresponding to the energy generating device and a covering member that covers the ink discharge section and an atmosphere-communicating opening for the ink container, wherein when the recording head is out of recording, a small opening communicating with the atmosphere-communicating opening, or a valve member capable of opening or closing in accordance with an internal pressure change, or an internal pressure change-absorbing member capable of absorbing an internal pressure change by changing its volume is provided on said covering member at a position corresponding to the atmosphere-communicating opening.

According to a second aspect of the present invention, there is provided an adjusting means for covering an atmosphere-communicating section of an ink container by tight adhesion to the atmosphere-communicating section through an adhesive and adjusting a pressure change in the ink container, wherein the adhesive has a good tight adhesiveness and a satisfactory peelability.

According to the third aspect of the present invention, a stable state of a recording head can be obtained in any surrounding circumstances by the adjusting means securely kept on the recording head by the adhesive. Even when the adjusting means is disengaged from the recording head, the desired state of the atmosphere-communicating section can be securely obtained due to the pealability of the adhesive. Particularly the effect is remarkable when the adhesive, as applied to the sealing tape, is used in the atmosphere-communicating section and the discharge section of the recording head.

Preferable adhesive contains acrylate ester copolymers obtained by cross-linking acrylic copolymers with isocyanate, the acrylic copolymers being obtained from at least 80% by weight of total of alkyl acrylate ester having OH groups and/or alkoxyalkyl acrylate ester having OH groups, and acrylate ester having an alkyl group or an alkoxyalkyl group of $C_4$ to $C_9$ as a side chain.

Preferable adjusting means for adjusting a pressure change is a means for keeping a tightly closed state when the internal pressure is normal, and making the internal pressure approach the external pressure when the internal pressure is increased to an abnormal state. For example, a member or a mechanism for keeping an ordinary (or contracted) volume at the normal internal pressure and increasing the internal volume with increasing internal pressure so as to absorb the internal pressure increment, while keeping the tightly enclosed state, or a member or a mechanism for tentatively forming a communicating section which communicates with the surrounding atmosphere while interlocking an increase in the internal pressure to such an extent as to prevent an abnormal state can be enumerated as the adjusting means. It has been found that practically stable internal pressure can be maintained if the area of the member or the mechanism is smaller than the opening area of the atmosphere-communicating section and larger than 0.005 $mm^2$. In the normal transportation, there is no problem, if the area is smaller than 0.1 $mm^2$, and there is no fear of ink leakage if the area is smaller than 0.05 $mm^2$ even with vigorous vibrations. These have been found to be preferable conditions.

Typical structures provided in accordance with the second aspect of the present invention will be given below together with detailed explanation thereof.

The present invention provides an ink jet recording head, which comprises an ink container with an atmosphere-communicating section, an ink discharge section communicating with the ink container, an energy generating device for discharging an ink supplied from the ink container through the discharge section, a tightly closing means for keeping the discharge section in a tightly closed state, and an adjusting means for covering the atmosphere-communicating means by tight adhesion to the atmosphere-communicating section in the tightly closed state kept by the tightly closing means through an adhesive and for adjusting a pressure change in the ink container, the adhesive component of the adhesive at the tight adhesion section of the adjusting means comprising acrylate ester copolymers obtained by cross-linking acrylate ester-containing acrylic copolymers with an isocyanate and having a good adhesiveness and a good peelability.

The present invention further provides an ink jet recording head, which comprises an ink container with an atmosphere-communicating opening, an ink discahrge section communicating with the ink container, an energy generating device for discharging ink supplied from the ink container through the ink discharge section, and a sealing member with an adhesive for covering the ink discharge section and the atmosphere-communicating opening, the adhesive component of the adhesive comprising acrylate ester copolymer obtained by cross-linking acrylate copolymers with an isocyanate, the acrylate copolymers being obtained from at least 80% by weight of total of alkyl acrylate ester having OH groups and/or alkoxyalkyl acrylate ester having OH groups, and acrylate ester having an alkyl group or an alkoxyalkyl group of $C_4$ to $C_9$ as a side chain, a smaller opening than the atmosphere-communicating opening being provided at a position corresponding to the atmosphere-communicating opening of the sealing member. This ink jet recording head can more securely attain the effect of the present invention.

The ink jet recording head with the sealing member having a smaller openings than the atmosphere-communicating opening at a position corresponding to the atmosphere-communicating opening in a tightly closed state, the smaller openings being made by puncture working can be effectively fabricated without peeling of the sealing member during the fabrication.

The present invention further provides a method for preserving an ink container having an absorber capable of generating a negative pressure by absorption of an ink within the container, an opening communicating the container inside with an exterior, and an ink supply section which is tightly closed during the preservation of the container, which comprises providing an adjusting means for adjusting a pressure change in the container at a position corresponding to the opening while providing an adhesive at the joint part for covering the opening, the adhesive component of the adhesive being acrylate ester copolymers obtained by cross-linking acrylic copolymers with an isocyanate, the acrylic copolymers being obtained from at least 80% by weight of total of alkyl acrylate ester having OH groups and/or alkoxyalkyl ester having OH groups, and acrylate ester having an alkyl group or alkoxyalkyl group of $C_4$ to $C_9$ as a side chain. The ink jet recording head can be immediately brought into a recordable state without any inconvenience according to the present method.

As a structure to which the present method for preservation can be applied, the present invention further provided an encasing vessel for an ink jet cartridge, which comprises a cover member and a container which forms an encasing space for an ink jet cartridge by joining the cover member, the encasing container having a wall that maintains the ink jet cartridge in a non-contact state and another wall projected towards the encasing space from the wall, thereby supporting the ink jet cartridge. With the present container vessel, conditions for producing a change in the internal pressure can be considerably reduced. Particularly occurrence of the state of producing ink leakage in the structure of communicating with the surrounding atmosphere under an abnormal condition can be considerably prevented and thus the above-mentioned adjusting means can be more simplified.

As an effective method, when an adjusting part capable of such deformation as not to be in a state communicating with the surrounding atmosphere is used or when an adjusting part capable of bringing the internal pressure into a slightly different state from the external pressure in the adjusting means, the present invention provides a method shown in FIGS. 23A–23C, that is, a method for handling an ink jet cartridge comprising an ink container having an absorber capable of generating a negative pressure by absorption of an ink within the ink container, an opening communicating the ink container inside with the exterior, an ink discharge nozzle capable of being tightly closed in the encasing space, an electro-thermal converter capable of generating heat energy for generating film boiling of ink according to an electrical signal, and a sealing member having an adjusting section for adjusting a pressure change in the encasing container provided at a position corresponding to the opening and provided with an adhesive at the joint for covering the opening, and a tightly closing part for tightly closing the ink discharge section, the adhesive component of the adhesive comprising acrylate ester copolymers obtained by cross-linking acrylic copolymers with isocyanate, the acrylic copolymers being obtained form at least 80% by weight of total of alkyl acrylate ester having an OH group and/or alkoxyalkyl acrylate ester having an OH group, and acrylate ester having an alkyl group or an alkoxyalkyl group of $C_4$ to $C_9$, wherein, when brought into a usable state, the sealing member including the adjusting section is parted off the ink jet cartridge, thereby making the opening open and then the sealing member is removed from a recording head, thereby making the ink discharge opening open. According to the method for handling an ink jet cartridge, ink scattering can be securely improved when the sealing member is abruptly peeled off.

BRIEF DESCRIPTION OF THE DRAWINGS

FIGS. 1A, 1B, 1C and 1D are a perspective view, a partially exploded view, and two partially cross-sectional views taken along line 1C—1C shown in FIG. 1A, respectively, showing a first embodiment of the present invention.

DESCRIPTION OF THE PREFERRED EMBODIMENTS

Figure 2:
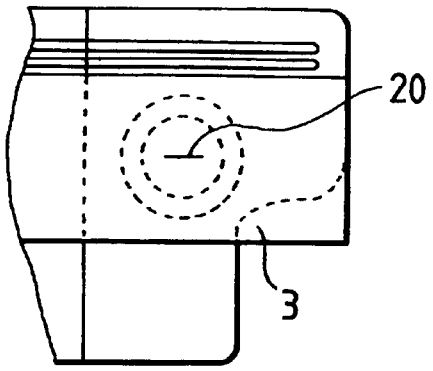
FIG. 2 shows a modified embodiment of the first embodiment as indicated by an arrow B in FIG. 1A.

The adhesive for use in the present invention is an acrylic resin-based adhesive. The present acrylic resin-based adhesive, particularly effective adhesive for use in an ink jet recording head, is a novel adhesive obtained as a result of extensive studies for attaining the above-mentioned objects of the present invention.

Acryl monomers for use in the present acrylic resin adhesive include, for example, alkyl ester monomers such as methyl acrylate, ethyl acrylate, propyl acrylate, isopropyl acrylate, butyl acrylate, isobutyl acrylate, 2-methylbutyl acrylate, 2-ethylbutyl acrylate, 3-methylbutyl acrylate, 1,3-dimethylbutyl acrylate, pentyl acrylate, 3-pentyl acrylate, hexyl acrylate, 2-ethylhexyl acrylate, heptyl acrylate, 2-heptyl acrylate, octyl acrylate, 2-octyl acrylate, nonyl acrylate, etc. and alkoxyalkyl ester monomers such as 2-ethoxyethyl acrylate, 3-ethoxypropyl acrylate, 2-ethoxybutyl acrylate, 3-methoxybutyl acrylate, 2-ethoxyethyl acrylate, 3-methoxypropyl acrylate, etc. These monomers are used in a range of 50 to 100% by weight, preferably 50 to 80% by weight as a total of the hydroxyl-containing monomers which follows.

Polyvalent isocyanate compounds for use in the present invention includes, for example, tolylene diisocyanate, hexamethylene diisocyanate, diphenylmethane diisocyanate, isophorone diisocyanate, xylylene diisocyanate, bis (isocyanatomethyl)cyclohexane, dicyclohexylmethane diisocyanate, lysine diisocyanate and trimethylhexamethylene diisocyanate, and adducts, urethane-modified products, allophanate-modified products, biuret-modified products, and isocyanulate-modified products of tolylene diisocyanate and hexamethylene diisocyanate, and urethane prepolymer (oligomer compounds having isocyanate groups at both ends).

A first procedure for adjusting the coagulating property according to the present invention and copolymerization with a hydroxyl-containing monomer and successive cross-linking with a polyvalent isocyanate compound.

Hydroxyl-containing monomers for use in the present invention include, for example, 2-hydroxylethyl acrylate, 2-hydroxypropyl acrylate, hydroxybutyl acrylate, 2-hydroxyethyl methacrylate, 2-hydroxypropyl methacrylate, hydroxybutyl methacrylate, acrylic acid esters of polyhydric alcohol, methacrylic acid esters of polyhydric alcohols, ethylcarbitol acrylate, methyltriglycol acrylate, 2-hydroxyethylacryloyl phosphate, butoxyethyl acrylate, etc. The hydroxyl-containing monomers are used in a range of 5 to 25% by weight, and part or whole of the hydroxyl-containing monomers is cross-linked with a polyvalent isocyanate.

A second effective procedure for adjusting the coagulating property is to properly use methacrylate monomer, vinyl acetate, styrene, acrylonitrile, acrylamide, or methacrylamide as a copolymerizable component, among which acrylonitrile, acrylamide and methacrylamide are particularly suitable for the present ink jet recording head, and are used preferably in a range of 5 to 15% by weight.

A third effective procedure for adjusting the coagulating property is to conduct cross-linking with N-methylolacrylamide, N-methylolmethacrylate, diacetoneacrylamide or butoxymethylacrylamide. The monomers for the cross-linking are used preferably in a range of 5 to 15% by weight.

It is more preferable to use the second and third procedures for adjusting the coagulating property together with the first procedure for adjusting the coagulating property.

A sealing tape with the above-mentioned acrylic resin-based adhesive can stably maintain a smaller opening corresponding to the atmosphere-communicating opening. When the smaller opening is made by puncture with a needle or by punching after tightly closing the atmosphere-communicating opening with the sealing tape, the sealing tape never peels off even by these puncture operations.

When more than 90 parts by weight of alkyl acrylate ester and/or alkoxyalkyl acrylate ester having a side chain of less than $C_4$ is used, Tg will be higher, resulting in a decrease in the adhesiveness to the discharge opening surface and occurrence of ink leakage, and consequently there is a possibility of peeling of the sealing tape when a smaller opening is made on the sealing tape on the atmosphere-communicating opening. When more than 90 parts by weight of the ester having a side chain of more than $C_9$ is used. Tg will be lowered, resulting in an increase in the adhesive force and the adhesiveness to the discharge opening surface. This leads to release of the adhesive from the substrate and consequent fouling of the discharge opening surface.

The present adhesive has a good chemical resistance to the ink jet ink, less disolution of organic matter, smaller content of polyvalent metals and excellent protectiveness of the ink jet head surface. In order to obtain these physical properties, an adhesive is prepared from the foregoing materials in the following manner.

(1) The above-mentioned monomers are subjected to solution polymerization in ketone, ester or an aromatic organic solvent obtain higher polymers having a weight average molecular weight of 250,000 to 700,000. In that case, it is important that lower polymer having a weight average molecular weight of 10,000 or less and residual monomers may not be contained in the resulting higher polymers. It is preferable to set appropriate polymerization conditions and remove lower polymer after the polymerization. It is the most secure method for removing the lower polymers to once form precipitates and dissolve the precipitates once gain into a good solvent.

(2) The above-mentioned monomers are subjected to emulsion polymerization or soap-free emulsion polymerization using a surfactant to obtain higher polymers having a weight average molecular weight of 250,000 to 1,000,000. In case of the emulsion polymerization, it is also preferable to remove unpolymerized monomers by redissolution of the resulting polymers in a good solvent such as xylene or ethyl acetate. Furthermore, it is desirable to remove lower polymers having a weight average molecular weight of less than 10,000 in the same manner as (1). Then, the polymers thus obtained are added to a diisocyanate to prepare a coating solution. The coating solution containing diisocyanate is applied to a support film in a thickness range of 5 $\mu$m to 100 $\mu$m, preferably 5 $\mu$m to 50 $\mu$m, and dried by heating in an ordinary drier. Drying conditions depend on the kind of the solvent used, but are usually in a range of 60° C. to 150° C. The dried film is preferably subjected to an aging treatment at room temperature by leaving it standing for 3 to 10 days.

When alkyl acrylate ester having OH groups and/or alkoxyalkyl acrylate ester having OH groups, and an alkyl group or an alkoxyalkyl group of $C_4$ to $C_9$ as an adhesive component is cross-linked with an isocyanate and the resulting polymers are used, ink leakage from the ink jet discharge opening can be securely prevented and a smaller opening corresponding to the atmosphere-communicating opening can be stably maintained. When the smaller opening is made by puncture with a needle or punching after the tight closing of the atmosphere-communicating opening with a sealing tape, the sealing tape is never peeled away by the puncture operation. Furthermore, when the sealing tape is forcedly peeled away by a user when an ink jet recording head is used, the adhesive never remains on the discharge opening surface due to coagulation breakage, and thus the ink jet recording head can be used immediately with better recording.

Particularly, when the acrylate polymers as an adhesive component contains 70 parts by weight of butyl acrylate, neither denaturing of a sealing tape nor dissolution of the adhesive component into the ink takes place, and particularly repeelability to the recording head is better. Resin or glass is often used as a constituent material together with a silicon substrate of the recording head in the following structure, the adhesive is not influenced even by a difference in the peeling state and never remains on the discharge nozzle surface due to coagulation breakage. Thus, use of the present recording head is not particularly limited.

When 90 parts by weight by acrylate polymers obtained by cross-linking of alkyl acrylate ester and/or alkoxyalkyl acrylate ester by an isocyanate is contained as an adhesives constituent, neither denaturing of the adhesive in contact with the ink nor dissolution into the ink occurs, and furthermore neither clogging nor unstable discharge occurs when used in a printer.

Films for use as an adhesive support of the present invention include, for example, films of polyethylene terephthalate, polypropylene, polyethylene, poly-4-methylpentane-1, polyvinyl chloride, vinylidene chloride-vinyl chloride copolymer, polyvinyl fluoride, polyvinylidene fluoride, tetrafluoroethylene-ethylene copolymer, tetrafluoroethylene-hexafluoropropylene-perfluoroalkyl vinyl ether copolymer, etc. These films can be subjected to a surface treatment by corona discharge treatment, flame treatment or plasma treatment to improve the adhesiveness of the adhesive. The support for use in the present invention has a thickness of 20 to 50 $\mu$m, preferably 25 to 35 $\mu$m.

When a peeling strength of the sealing tape on stainless steel (SUS 304) is set to 200 g/25 mm–1,200 g/25 mm, a stable tendency is observable overall, and thus this can be taken up as one of preferable conditions besides the above-mentioned structure. Under that condition, no peeling of the sealing tape off the atmosphere-communicating opening is observed when a smaller opening is made on the atmosphere-communicating opening.

Peeling strength is determined by a 180°. peeling test at 25° C. in a testing machine set forth in JIS-B-7721, using a stainless steel plate (SUS 304) as a substrate at a pulling speed of 300 mm/min and a pulling load of 2.0 kg. The thickness of an adhesive layer is in a close relation to a peeling strength, and thus in determining a peeling strength, the thickness of an adhesive layer may be set to 5–70 $\mu$m, preferably 20–50 $\mu$m. In any way, no adhesive remains even if the thickness of an adhesive layer is larger, and a desired sealing tape can be obtained.

The sealing tape for use in the present invention is effective also for an ink repellence-treated discharge opening surface and a good adhesiveness can be maintained without denaturing of the sealing tape and the discharge opening surface.

The ink repellence-treated surface is a lead surface treated for example, with silicone oil, or a low molecular weight or a high molecular weight fluorine-containing polymer. The ink repulsion agent includes, for example, KP-801 (trademark of a product by Shinetsu Silicone K.K., Japan), Diffenser (trademark of a product made by Dainippon Ink K.K., Japan), CTX-105 and 805 (trademarks of products made by Asahi Glass K.K., Japan), Teflon AF (trademark of a product made by DuPont, USA), etc. The smaller opening to be made on a sealing tape on the atmosphere-communicating opening most preferably has a cross-sectional area of 0.05 mm$^2$ or less. Number of small aperture is not limited to any one, but a plurality of aperture can be also made. A slit-formed aperture may be provide without any trouble. The smaller opening can be made by puncture with a needle, a laser or other means, and any means can be used to make the smaller opening.

FIGS. 1A, 1B, 1C and 1D are a perspective view, a partially exploded view, and two partially cross-sectional views of FIG. 1A, respectively, according to the first embodiment of the present invention. The present recording head has a sealing member that covers an ink discharge section and an atmosphere-communicating opening for an ink container, and a press member for pressing the sealing member to the ink discharge section, where an opening 20 communicating with the atmosphere-communicating opening is provided on the sealing member that covers the atmosphere-communicating opening when the recording head is out of recording.

Figure 7:
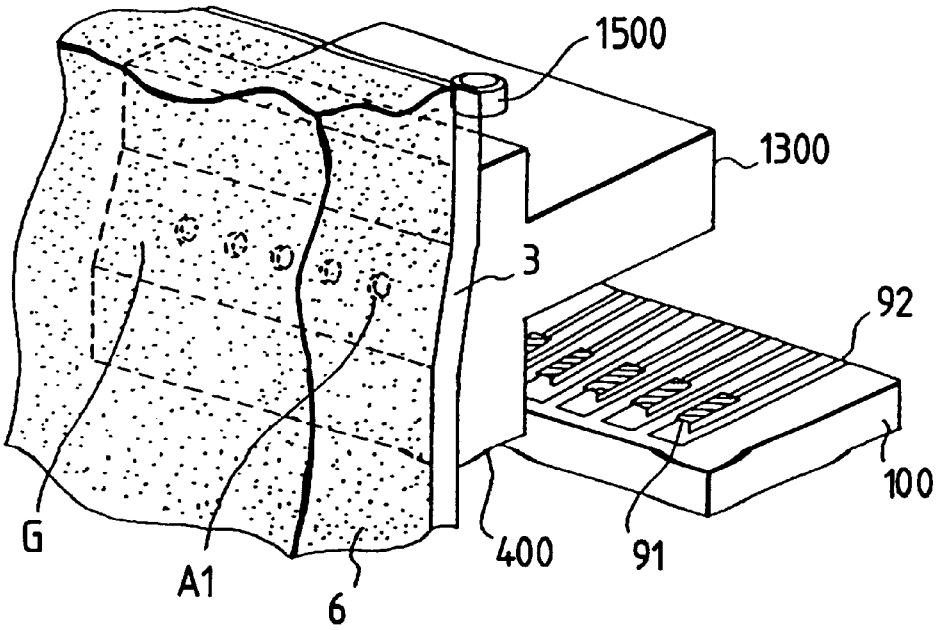
FIG. 7 is a partial schematic view showing an embodiment of the present invention.

In FIGS. 1A and 1B, IJC indicates an ink jet cartridge, which is a recording head having an ink absorber in an ink container, where an ink is supplied from the ink container through a supply tube communicating with the ink container, the recording head being provided with a heat energy generator 91, a substrate 100 with electrodes 92 formed thereon, and an orifice plate 400 provided with a plurality of discharge opening A1, as shown in FIG. 7, and being detachable from a recording apparatus body formed integrally. In this embodiment a ceiling plate 1300 and a plate 400 are integrally molded to form a liquid path 140. S is an opening for inspecting an electrical joint, which will be explained later, and is provided on the top surface of the recording head. Numeral 10 is a base plate of recording head substrate, which is an aluminum plate integrally formed together with a positioning site 8 for positioning the recording head entirety through engagement with a positioning member 4010 of a carriage of the recording apparatus body shown in FIG. 8. Numeral 1 indicates a discharge section surface including the orifice plate, and 41 indicates a recording ink discharge section. In this embodiment, an opening for absorbing back waves during the recording or openings such as dummy nozzles, etc. are not shown in the drawings, but the discharge section surface 1 can be deemed to include these members not shown in the drawing. Numeral 2 is a grooves section provided on the upper and lower surfaces receded from the discharge section surface 1. In this embodiment four grooves are formed as shown in the drawing. Numeral 53 is a side groove section positioned at the side against the base plate 10 and provided with four grooves each connected to the grooves on the groove section 2. When a large amount of ink is accumulated in the groove section Z due to scattering of ink, the accumulated ink can be led downwards through the side groove section 53. The groove section 2 of the recording head is to keep an engagement with the groove section 31, 51 of a cap 4 through an elastic pressing force.

Numeral 3 is a sealing sheet, which has such a size as to cover the discharge section surface 1 of the recording head entirely and also to cover the atmosphere-communicating opening entirely.

Figure 3:
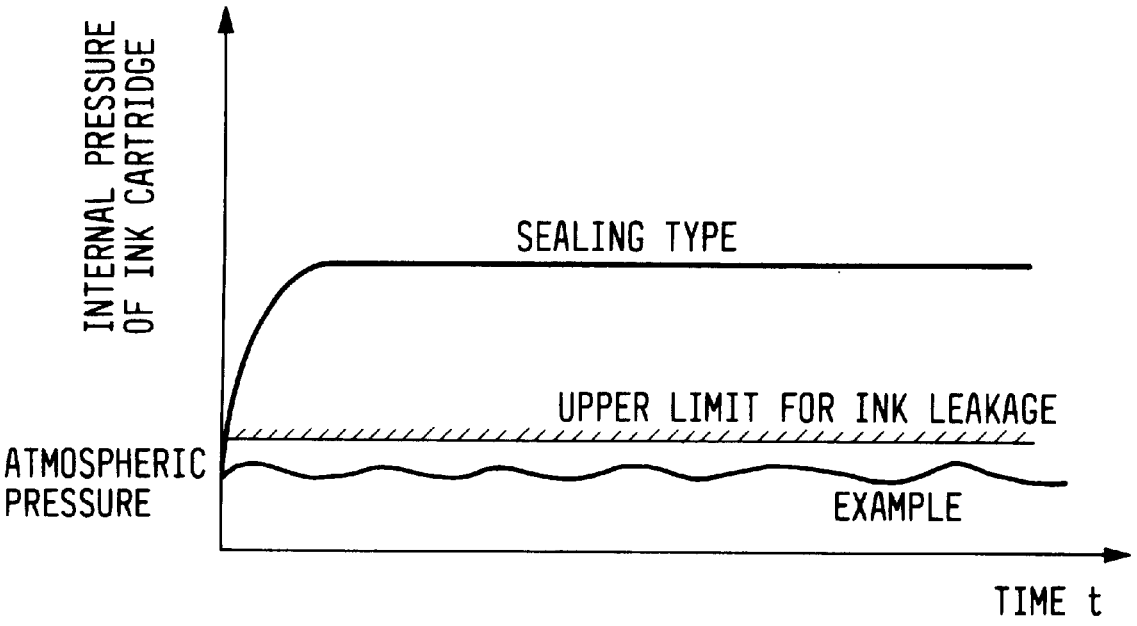
FIG. 3 is a diagram showing an internal pressure elevation in an ink cartridge.

When an opening 20 with an area of at least 0.005 mm$^2$, which communicates with the atmosphere-communicating opening, is provided on the sealing sheet 3, the ink cartridge internal pressure can be kept substantially under the atmospheric pressure at changing surrounding temperatures, particularly in a high temperature circumstance without elevating an internal pressure as shown in FIG. 3. When various tests (falling test, vibration test, etc.), which are to be encountered during the transportation, are carried out with an aperture area of not more than 0.05 mm$^2$, equivalent results to those in the tightly sealed state can be obtained without any increase in the internal pressure of the ink container. It can be seen from the foregoing that the opening 20 preferably has an area of 0.005 to 0.05 mm$^2$ in this embodiment.

In the drawings, the number of opening is only one, but a plurality of opening is not objectionable. As shown in FIG. 2, the same function as above can be obtained when the opening is in a slit form. Opening can be made with a needle on laser, or punching. A procedure for making opening is not limited to these.

Figure 4A:
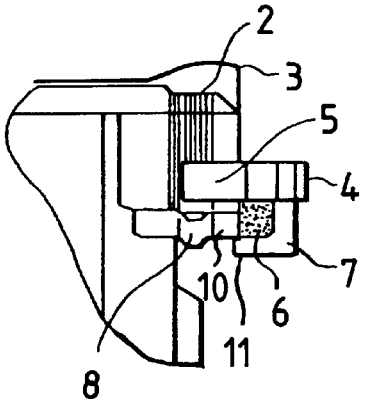
FIGS. 4A and 4B are partial schematic views of the first embodiment.

The internal pressure of the ink cartridge can be kept under the atmospheric pressure by providing an opening through the sealing member that seals the atmosphere-communicating opening, as described above, whereby ink leakage from pinholes at the welded parts due to an internal pressure increase can be eliminated. The sealing sheet 3 has a part projected outwards from the recording head edge as shown in FIG. 4A. The projected part serves as a tag for peeling the sealing sheet from the recording head. The sealing tape 3 is fixed to the recording head in a simple bonding state through an adhesive between the sealing sheet 3 and the discharge section surface 1 as shown in FIG. 1B.

In FIGS. 1A and 1B, a cap 4 has a width corresponding to the discharge section surface 1, and is integrally provided with two counterposed arms 5, an elastomer 6 apart from the arms and fixed to the inside of the cap, a member 7 for positioning or controlling an elastic deformation, fixed on the base plate 10—facing side of the cap, and projections 9 utilizable for detaching the cap 4 itself from the recording head. The arms 5 each have on the inside three groove sections 51 engageable with the groove section 2.

Figure 4B:
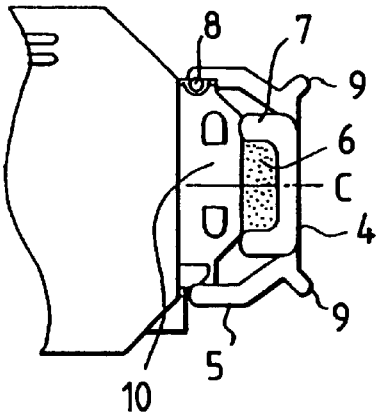

In this embodiment, as is apparent from FIGS. 4A and 4B the sealing sheet 3 is extended over the base plate 10 and the elastomer 6 is provided to reach the base plate 10. Since the discharge opening 41 is positioned near the base plate 10, the elastomer serves to improve a higher tight sealing effect. The member 7 has such a length as to slightly contact the back side of the base plate 10, when the cap 4 is engaged with the recording head. The contact length is about 1 mm in this embodiment. The slight contact construction can securely positions the elastomer 6 of the cap within such a range that the base plate 10 can be held by the arms 5 and the positioning member 7. That is, the tight sealing effect can be obtained at the opening through a simple structure without the above-mentioned problems of the adhesive.

Figure 5A:
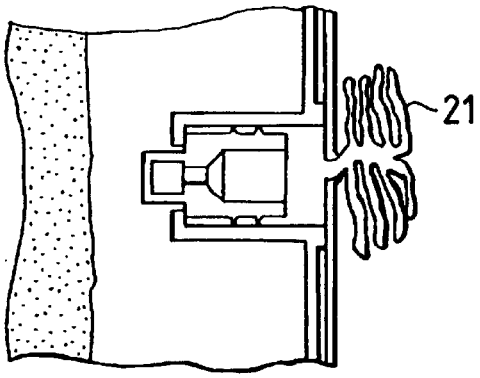
FIGS. 5A and 5B are views showing a second embodiment of the present invention.
Figure 5B:
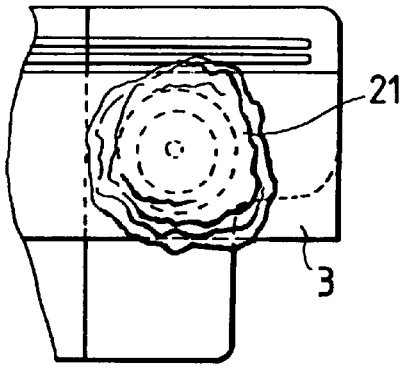

FIGS. 5A and 5B shows a second embodiment, where a bag-like member 21 which communicates with the atmosphere-communicating opening is provided. Air in the ink container expands due to an internal pressure increase in the ink container. The expanded air expands the bag-like member 21 to absorb the internal pressure increase, thereby keeping the internal pressure in the ink container substantially under the atmospheric pressure.

The bag-like member 21 is used only when the recording head is out of recording. That is, the bag-like member 21 is removed when the recording head is used. In this sense, it is desirable that the bag-like member 21 is integrated with the sealing member 3. It is not objectionable that the bag-like member 21 is separated from the sealing member 3. Other structures than that of the bag-like member are the same as those of the first embodiment.

Figure 6:
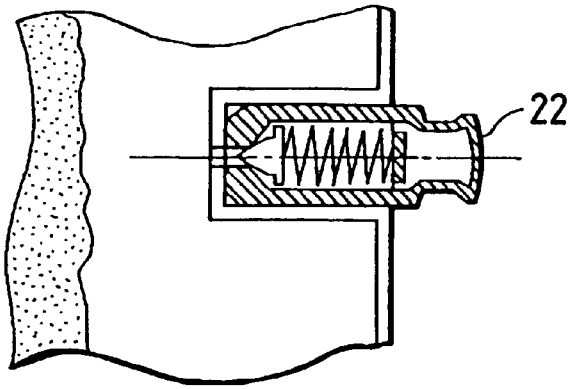
FIG. 6 is a view showing a third embodiment of the present invention.

FIG. 6 shows a third embodiment of the present invention, where a valve 22 is provided at the atmosphere-communicating opening. When the internal pressure in the ink container is increased. The valve 22 is opened to release the internal pressure of the ink container. When a difference between the internal pressure and the external pressure is less than a preset value, the valve 22 is closed. It is desirable that the difference between the internal and external pressures is not more than 0.05 atm. When the difference exceeds 0.05 atm and is maintained at 0.05 atm or more, ink leakage is liable to occur. In the third embodiment, the valve 22 at the atmosphere-communicating opening is removed when the recording head is used. Other structures than the valve at the atmosphere-communicating opening are the same as those of the first embodiment.

Figure 8:
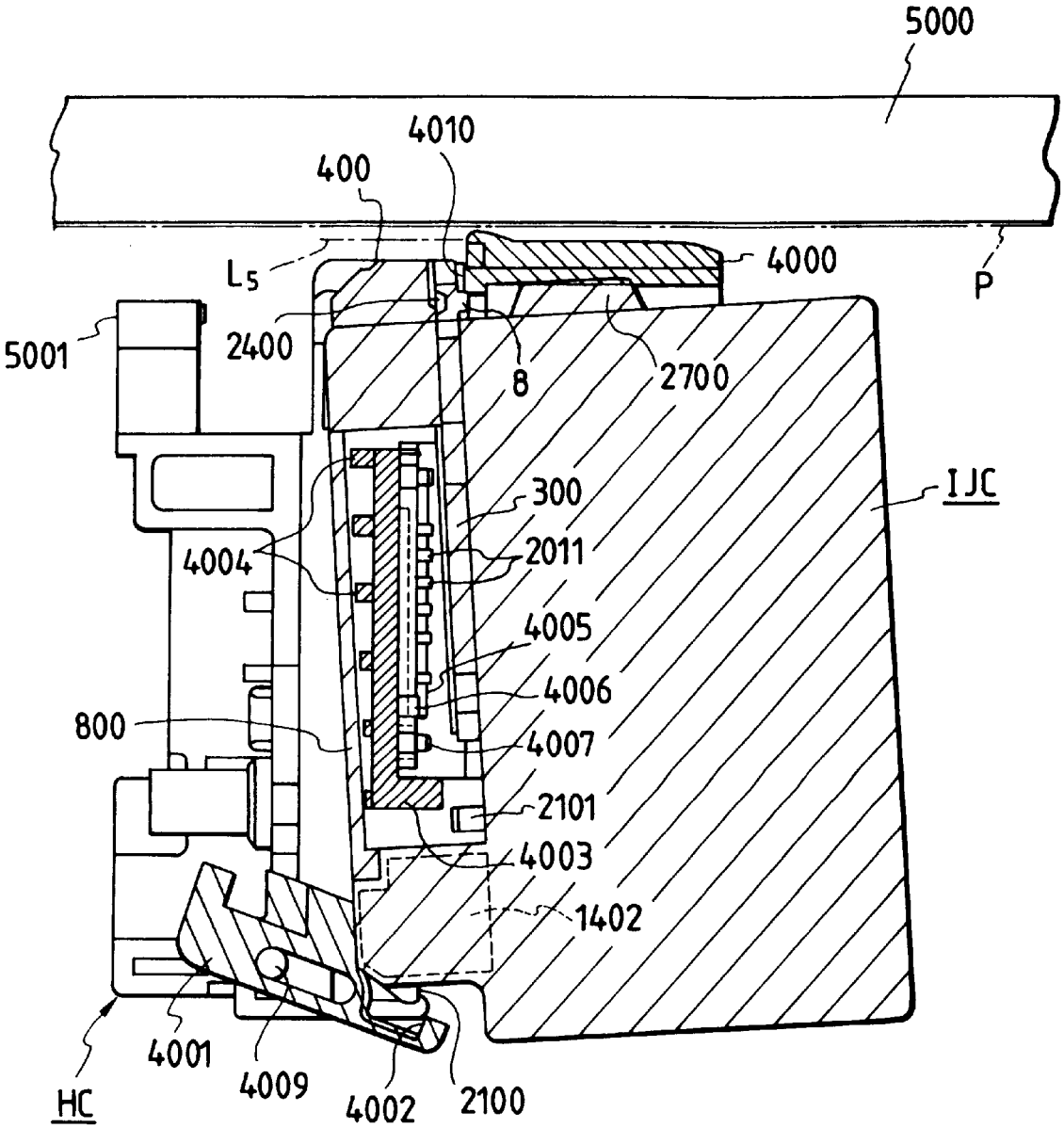
FIG. 8 is a partial cross-sectional view showing a detachable structure of the present recording head to a recording apparatus proper.

As is clear from the perspective view of FIG. 8, the ink storing proportion of IJC is higher, and the tip end of the ink jet unit is projected slightly from the front surface of the ink container. The ink jet cartridge IJC is fixed to and supported by the carriage HC mounted on the ink jet recording apparatus body IJRA, a positioning means which will be explained later and an electrical contact, and is of detachable, disposable type with respect to the carriage HC.

In FIG. 8, a platen roller 5000 guides a recording medium P from the down side to the up side of the drawing. Carriage HC moves along the platen roller 5000 and is provided with a front plate 4000 (thickness: 2 mm) positioned at the front side of the ink jet cartridge IJC at the forward platen side of the carriage, a support plate 4003 for electrical connection which holds a flexible sheet 4005 provided with pads 2011 corresponding to pads 201 of a wiring substrate 200 of the cartridge IJC and a rubber pad sheet 4007 for generating an elastic force that presses the flexible sheet 4005 to the respective pads 2011 from the back side, and a positioning hook 4001 for fixing the ink jet cartridge IJC to the recording position. The front plate 4000 has two positioning projected surfaces 4010 corresponding to the positioning projections 2500 and 2600, respectively, of the cartridge support 300 and is subject to a vertical force directed to the projected surface 4010 after the mounting of the cartridge. Thus, the reinforcing ribs have a plurality of ribs (not shown in the drawing) directed to the vertical force at the platen roller side of the front plate. The ribs also form head-protecting projections that project towards the platen roller side slightly (about 0.1 mm) from the front surface position L5 when the cartridge IJC is mounted. Support 4003 for electrical connection section has a plurality of reinforcing ribs 4004 not in the rib direction, but in a vertical direction, and in a reducing projection size from the platen side towards the hook 4001 side. The reinforcing ribs also have function to incline the position at the cartridge mounting as shown in FIG. 8. To stabilize the electric contact state, the support plate 4003 has two positioning surfaces 4006 at the hook side corresponding to the projected surfaces 4010 for giving a working force to the cartridge is an opposite direction to the working direction at which the two positioning projected surfaces 4010 act on the cartridge, and forms a pad contact region between the positioning surface 4006 and decides deformation ratios of buttons on a rubber sheet 4007 provided with buttons corresponding to the pads 2011 one-sidedly. These positioning surfaces will be brought into contact with the surface of the wiring substrate 300, when the cartridge IJC is fixed to the recordable position. In this embodiment, the pads 201 of the wiring substrate 300 are distributed symmetrically with respect to the line $L_1$, and thus the deformation ratios of the individual buttons on the rubber sheet 4007 are made uniform and the contact-pressure of the pads 2011 and 201 is more stabilized. In this embodiment, distribution of pads 201 is two rows on each of the up side and the down side and two rows in the longitudinal direction.

Hook 4001 has a long slit which is engaged with a fixed axis 4009, and rotates in the counterclockwise direction from the position shown in FIG. 8 by virtue of the movable space in the long slit and then moves towards the left side along the platen roller 5000 to position the ink jet cartridge IJC with respect to the carriage HC. The hook 4001 can be moved by any means, but preferably by such a structure as a lever, etc. Anyway, during the rotation of the hook 4001, the cartridge JIC moves towards the platen roller, while the positioning projections 2500 and 2600 moves to such a position where they can contact the positioning surface 4010 of the front plate. By movement of the hook 4001 towards the left side, the hook surface 4002 at 90° is kept in close contact with the surface at 90° of the nail 2100 of cartridge IJC to rotate the cartridge IJC in the horizontal plane around the contact region of the positioning surface 2500 and 4010 themselves as a center and finally the pads 201 and 2011 themselves are brought into contact with one another. When the hook is kept at a predetermined position, that is, a fixed position, complete contact of the pads 201 and 2011 themselves, complete face contact of the positioning surfaces 2500 and 4010, two-face contact of the 90° face 4002 and the 90° face of the nail, and face contact of the wiring board 300 and the positioning surface 4006 are formed at the same time to complete engagement of the cartridge IJC with the carriage.

In the figure, the nail 2100 that engages with the engageable surface 4002 at 90° of the hook 4001 for positioning the carriage is shown in such a structure that the working force for positioning the carriage can act in a plane region in parallel to the reference plate.

Common structure throughout the above described embodiments and the following embodiments can be summarized as a structure comprising a sealing member having the above-mentioned adhesive layer that can seal a discharge section and an atmosphere-communicating opening for an ink tank and a smaller opening as an internal pressure-adjusting part, and a pressing means that can press the sealing member onto the discharge opening.

According to the present invention, a recordable state of a recording head can be provided without any ink scattering, irrespective of the degree of inertial resistance, even if the recording head is transported or sold in the various worst state of high temperature, high humidity, etc.

Figure 17:
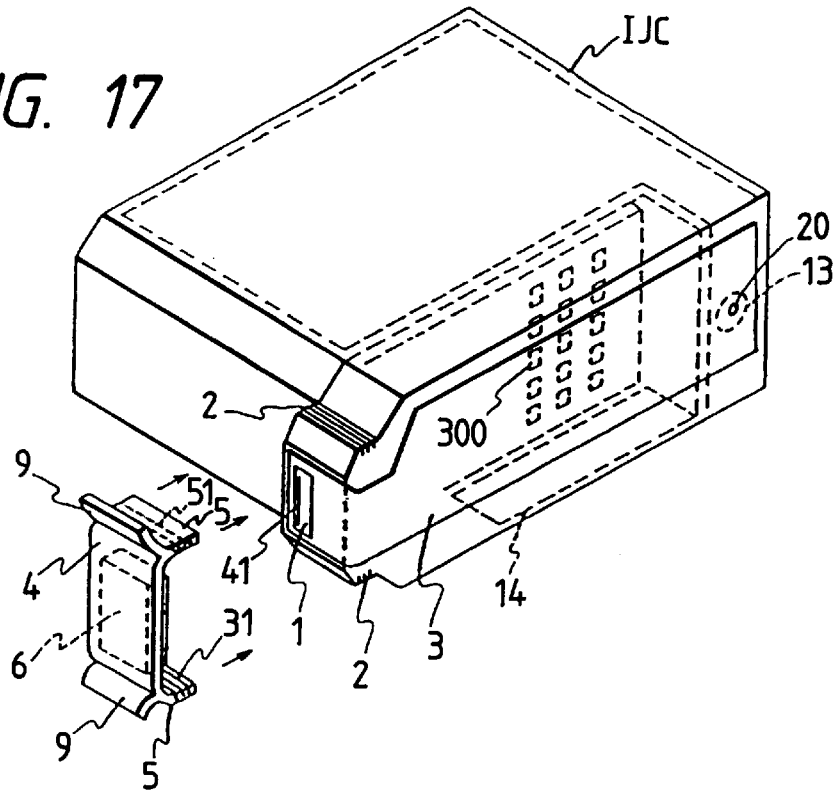
FIG. 17 is a perspective view of a modified recording head structure according to the present invention.
Figure 18:
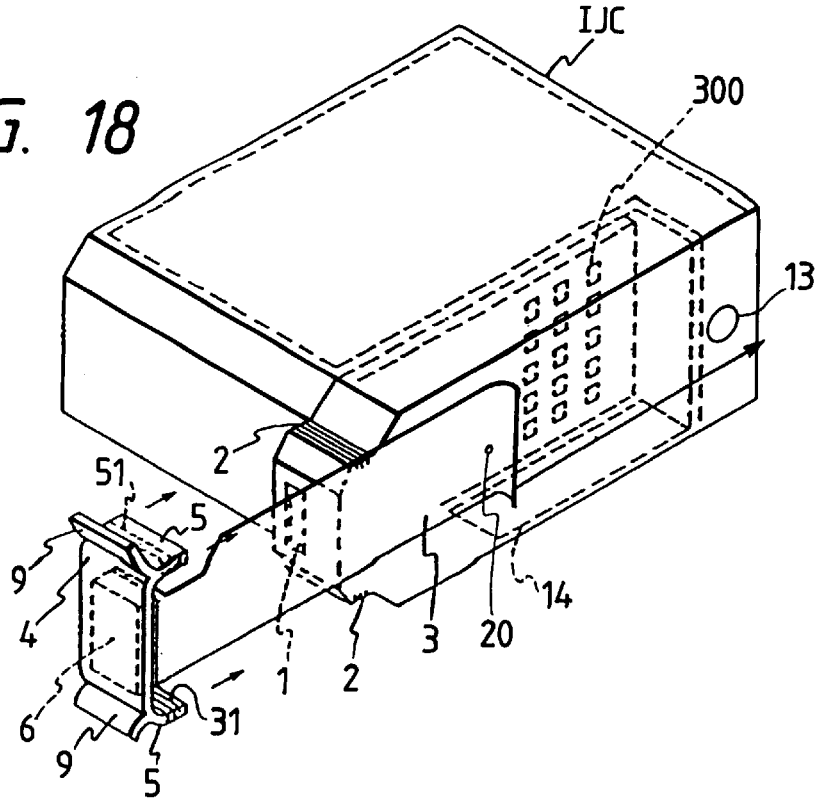
FIG. 18 is a perspective view of another modified recording head structure according to the present invention.

FIGS. 11A and 11B and FIGS. 12A and 12B are a plan view and a side view respectively, showing a modification of the embodiment of FIGS. 4A–4B; FIG. 13 is a schematic view of a recording head cross-section of the embodiment of FIG. 7; FIGS. 14A, 14B and 14C, FIGS. 15A, 15B and 15C, and FIGS. 16A, 16B and 16C are side views, front views and plan views, respectively, showing further embodiments of the present invention; and FIGS. 17 and 18 are perspective views of embodiments of modified recording head structures of the present invention.

Figure 11A:
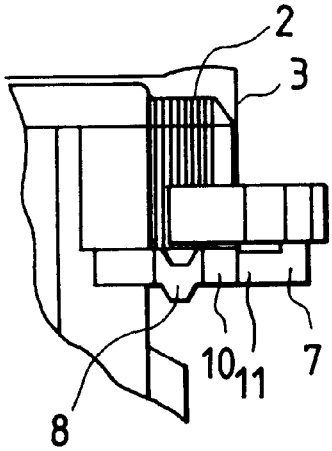
FIGS. 11A and 11B are a plan view and a side view in the schematic view showing a modification of FIGS. 4A and 4B, respectively.
Figure 11B:
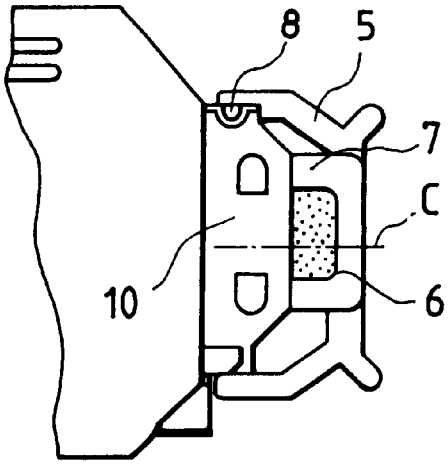

FIGS. 11A and 11B show such a structure that the pressing region of the elastomer is concentrated on the discharge opening where the base plate 10-facing part is omitted from the structure of the elastomer of FIGS. 4A and 4B. In this embodiment the member 7 act as member for controlling elastic deformation, and thus the entire discharge opening can be tightly sealed with uniform pressure distribution. Thus, this embodiment is a preferred embodiment. In FIGS. 11A and 11B, the structures other than the above are the same as in FIGS. 1A–1D and FIGS. 4A and 4B.

Figure 12A:
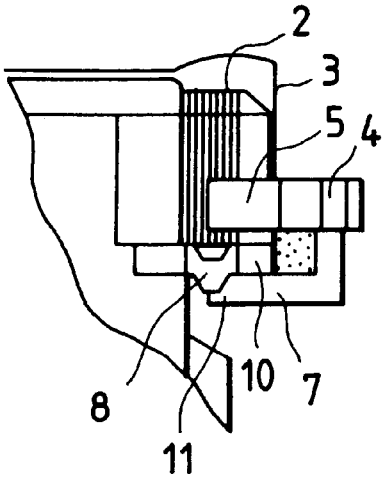
FIGS. 12A and 12B are a plan view and a side view in the schematic view showing another modification of FIGS. 4A and 4B, respectively.
Figure 12B:
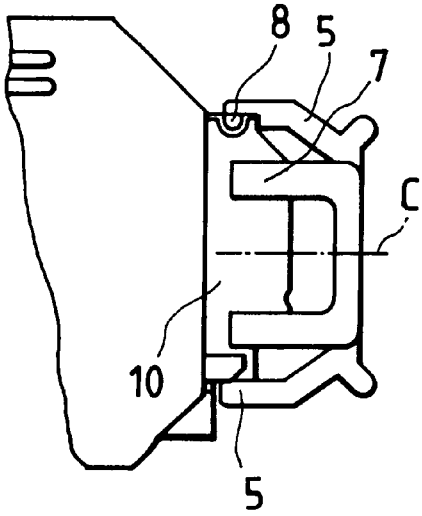
Figure 13:
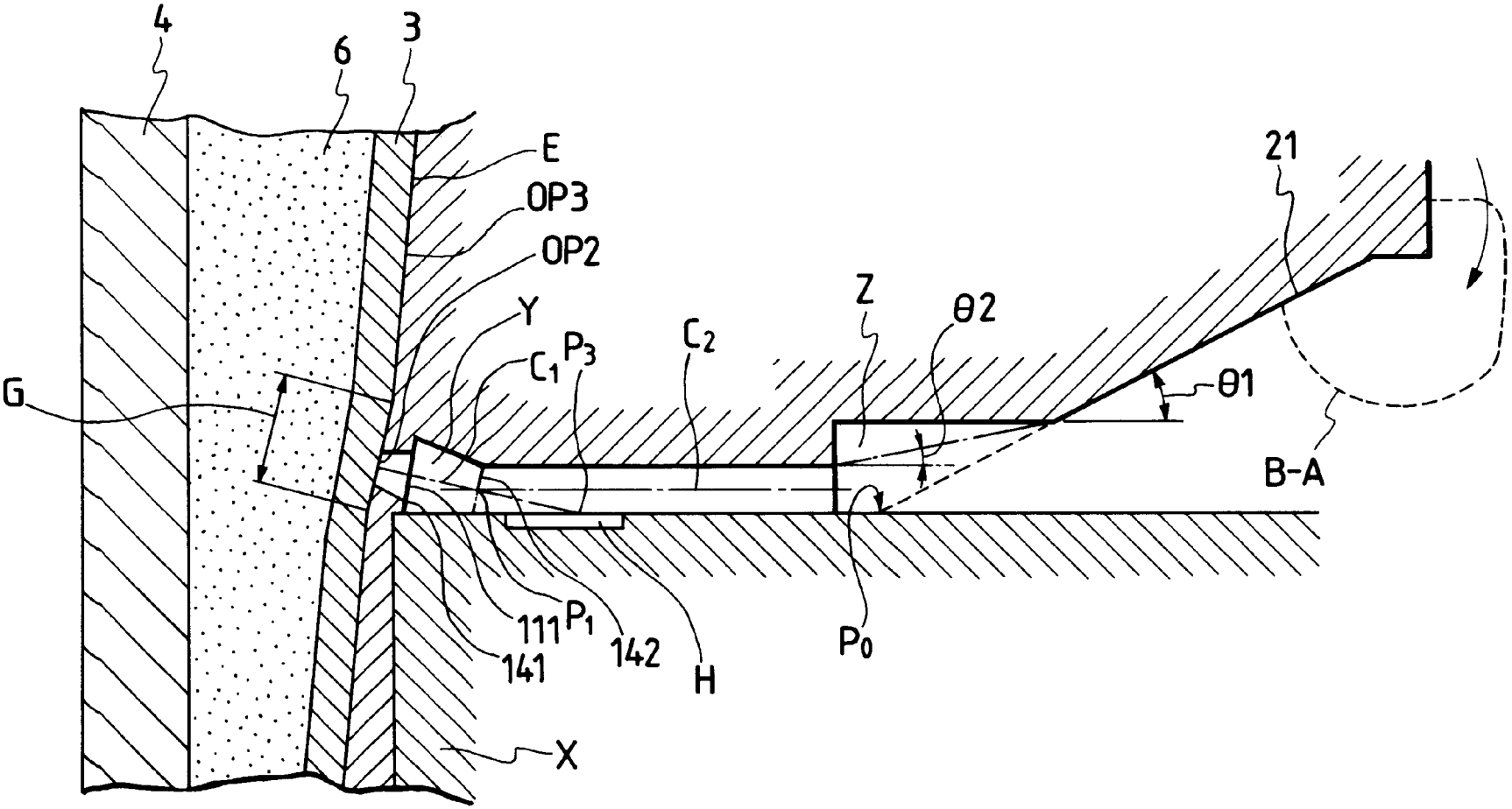
FIG. 13 is a schematic view of the recording head cross-section according to the embodiment of FIG. 7.

FIGS. 12A and 12B show such a structure that member 7 of FIGS. 4A and 4B are further extended to act as a guide for fixing the cap member 4 to the recording head. In this embodiment, the members 7 have the same length as that of the arms 5. Thus, the cap cannot be fixed to the recording head, if the members 7 are not securely positioned to the back side of the base plate 10, and thus operability can be more improved when a smaller cap 4 with a smaller elastomer is fixed to the recording head.

Engagement of grooves 2 and grooves 51 in the foregoing embodiments will be explained below. When the projections 9 are moved inwardly by pinching the projections at the fixing, the arms 5 undergo elastic deformation so as to broaden the distance, and the recording head is inserted between the arms 5 of the cap in the broadened state. Then, the pinched projections are released from the pinching, whereby the grooves 2 and the grooves 51 are engaged with one another. Even if a dislocation by one groove occurs between the grooves 2 and 51, mutual balance between the elastic pressing force of the arms and the elastic force due to the deformation of the elastomer 6 can be readily-adjusted by the setting the groove depth to less than 1 mm. When the engagement of upper grooves and lower grooves are made in equal number in that state, an appropriate total balance is established, and thus the tightly sealed state can be assured and an appropriate pressure balance can be obtained. That is, a tight sealing can be obtained. Any elastic material or any thickness can be selected for the elastomer 6, if they can press the sealing tape 3 in the engagement of the grooves 2 and 51 to maintain the tight sealing force.

According to a specific structure of this embodiment, the sealing tape 3 is a base film 4 coated with an acrylic resin-based adhesive, where the base film is a flexible sheet having a thickness of about 12 to about 30 $\mu$m, such as a polyethylene terephthalate film or poly-tetrafluoroethylene film, and the elastomer is a sponge having a thickness of about 3 mm, such as silicone sponge or polyurethane sponge. The present invention is not limited to this specific structure.

FIGS. 7 and 13 show an embodiment of a discharge section where a difference of about 30 $\mu$m in the height between the upper surface and the lower surface is formed on the difference-forming plane G having a width of 70 $\mu$m. According to the present invention, a tightly sealed state can be securely obtained on the surface with a difference in the height. As is apparent from FIG. 13, a liquid chamber has a region Z connected to a liquid path and extended is the ink receptor and an inclined surface 21 towards the region Z from the ink receptor, and the extended line of the inclined surface 21 reaches a surface position Po on the substrate 8 as a side surface of the discharge energy generating means H in the liquid path facing the region Z. In this embodiment the inclined surface 21 is at an angle of 22° to the center line C2 of the ink liquid path and the extended line of the liquid path, and the angle B of the left and right in side wall surfaces is 15°.

By the presence of the extended region Z, not only five bubbles are gathered, but the gathered bubbles are kept in the region apart from the extended liquid path at which the discharge energy generating means H exists. Even if the bubbles are made larger, the bubbles are guided in the direction far from the liquid path along the inclined surface. That is, generation of recording failure can be considerably retarded.

Furthermore, since the extended line of the inclined surface reaches the side surfaces of the discharge energy generating means in the liquid path facing the region Z, larger bubbles cannot enter the liquid path due to the presence of the side surface of the discharge energy generating means as a barrier, even if the existing bubbles are forced into the liquid path by generated impacts, and thus no recording failure occurs at all. The present ink jet recording head is not limited to the above-mentioned angles. When the structure is provided with the angular limitation, a much higher effect can be obtained, as obvious from the foregoing explanation.

The following structure is particularly effective for a suction regaining and also for pressure regaining. Numeral 141 indicates a trapezoidal shape with sides of equal length at the open end of the liquid path at the orifice plate side, 111 indicates a trapezoidal shape with sides of equal length at the open end of the orifice plate in contact to the open end of the liquid path to show that the discharge section also has a trapezoidal shape with sides of equal length. In this embodiment, the ink transport path has a cross-section of trapezoidal shape with sides of equal length from the liquid path to the discharge section. That is, if a liquid path of trapezoidal cross-section has the bottom craft the side of the discharge energy generating mean, the conditions for dispersing the generated bubbles over the entire inside surfaces of the liquid path can be made uneven, and thus the generated or introduced bubbles are gathered towards the smaller surface side of the trapezoidal shape and also the discharge routes for the bubbles at the regaining can be concentrated, thereby much increasing the bubble discharge effect. If the discharge section corresponding to the liquid path of the trapezoidal cross-section has the smaller surface at the side of the smaller surface of the trapezoidal cross-section of the liquid path and the larger surface at the side of the larger surface thereof, generation of ink turbulent state can be prevented at the regaining, thereby stabilizing the bubble discharge effect. It is preferable that the shape is a trapezoidal shape with sides of equal length. In this embodiment, the most preferable shape has a region I where the liquid path is extended in the trapezoidal shape with sides of equal length as such to a position near the discharge section of the liquid path (liquid path from line P1 to the openings 141 and 111) and a region II narrower than the liquid path in a trapezoidal shape with sides of equal length as such and connected to the discharge section in a trapezoidal shape with sides of equal length (opening 11 to opening 11), and thus bubbles can be securely removed without generation of ink turbulent flow. In FIG. 13, the region I any region II are symmetrical along the plane formed by connecting the centers of the sides of the trapezoidal cross-sections of the liquid path (line C10), and the pressure distribution at the regaining can be made even, and generation of fine turbulent flows in the discharge region can be considerably reduced. The extended line from the line C1 reaches a point P3 on the surface of the heat energy generating device H, and thus the discharge energy can be efficiently consumed for the discharging.

According to the present invention, the ceiling plate member and the discharge section-forming member for constituting the common liquid chamber can be integrated, and a liquid path-forming member having a height differential part for engaging with the substrate and a pressure member for holding the tip end of the substrate to be engaged with the height difference part under pressure by applying a linear pressure to the liquid path-forming member in the arranging direction of the liquid path from the upper side of the liquid path can be used, whereby the trouble due to the generation of bubbles can be overcome and good recording can be carried out.

In this embodiment, the orifice plate is formed at difference angles OP1, OP2, and OP3 (point of inflections: H, I) and the discharge direction of liquid droplets is constant in the extended direction of the line C1. Thus, the recording surface is a plane vertical to the line C1. In this embodiment, a recording medium moves from the downside to the upside of the drawing sheet. Since the orifice plate is a plate member whose surface, at which the discharge section is provided, has a stage-wise cross-sectional shape with a gentle gradient, and thus cleaning can be securely much improve at the wiping without fixing any special parts to the inside or the outside of the cap, and also prevention of ink meniscus, retreatment at the discharge nozzle section when capped can be effectively attained. Thus, the ink discharge failure and various problems derived therefrom can be effectively overcome in the simple structure as such.

It is preferable that the height of the region Z in FIG. 6 is equal to or less than that of the liquid path, and the equal $\theta_2$ formed by the region Z in FIG. 3 is 10°, and preferably less than a half of the angle $\theta_1$ of the inclined plane 21.

As is apparent from FIG. 13, the surface and the periphery of the discharge opening is securely and tightly sealed with the sealing tape 3, and this state is maintained by the elastically deformed state of the elastomer 6. Thus, a more distinguished effect can be obtained than those so far obtained.

Figure 14A:
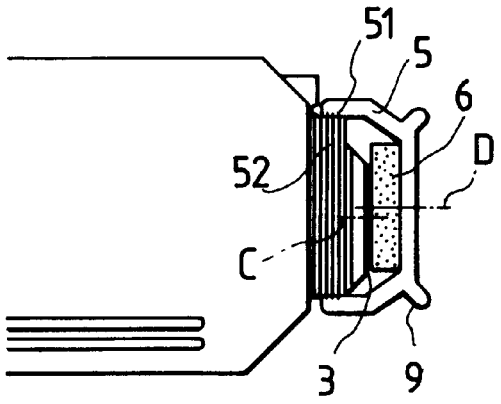
FIGS. 14A, 14B and 14C are a side view, a front view and a plan view of showing other embodiment of the present invention, respectively.
Figure 14B:
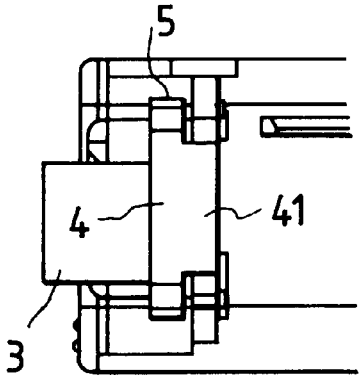
Figure 14C:
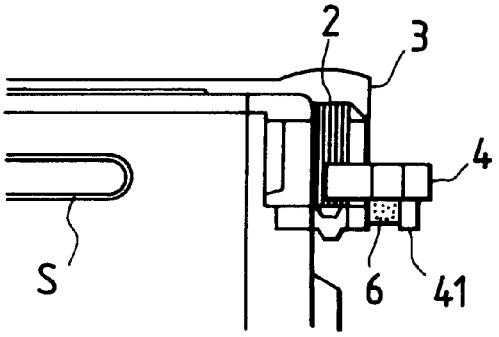

Embodiment shown in FIGS. 14A, 14B and 14C shows the structure free from the members 7 of the embodiment of FIGS. 4A and 4B.

Thus, parts of the elastomer 6 that presses the base plate 10 are securely pressed by the extended parts of the cap body. This structure has an advantage with respect to the simplification of cap member and detachment of the cap from the recording head being carried out by sliding along the upper grooves 51.

Figure 15A:
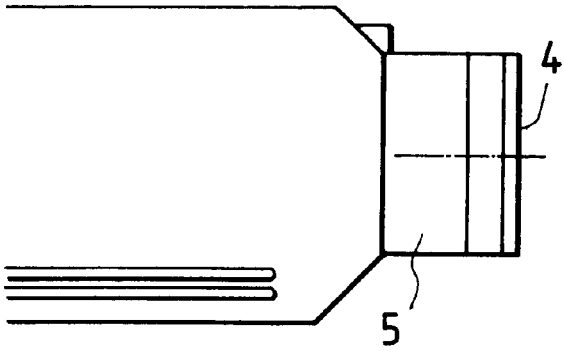
FIGS. 15A, 15B and 15C are a side view, a front view and a plan view of further embodiment of the present invention, respectively.
Figure 15B:
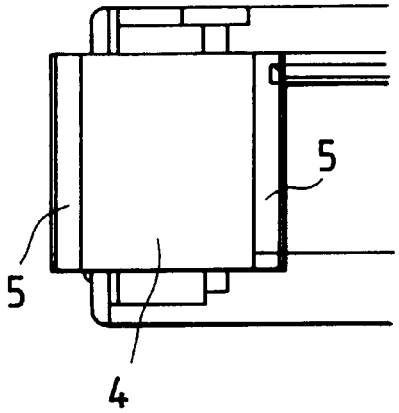
Figure 15C:
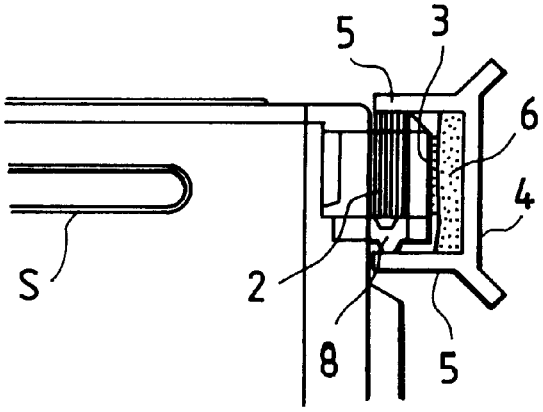

FIGS. 15A, 15B and 15C show a structure for engaging the positioning members 8 of base plate 10 with the grooves 53, where the sealing tape 3 is provided only at the inside of the cap. This structure is an embodiment of increasing the substantial fixing accuracy, utilizing the positioning accuracy of the recording head to the recording apparatus.

Figure 16A:
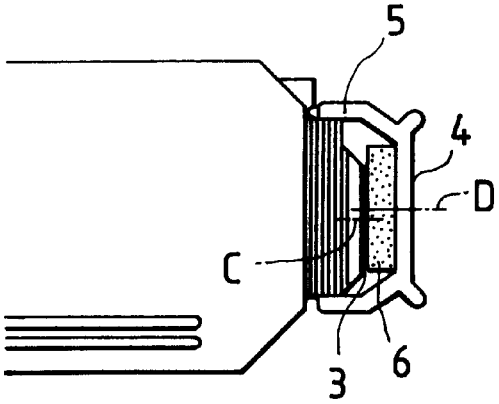
FIGS. 16A, 16B and 16C are a side view, a front view and a plan view of still further embodiment of the present invention.
Figure 16B:
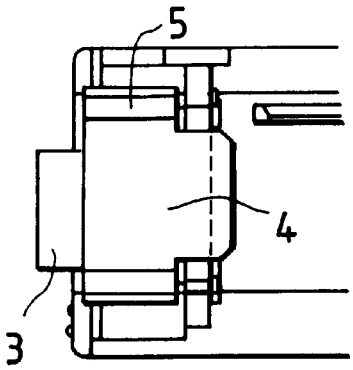
Figure 16C:
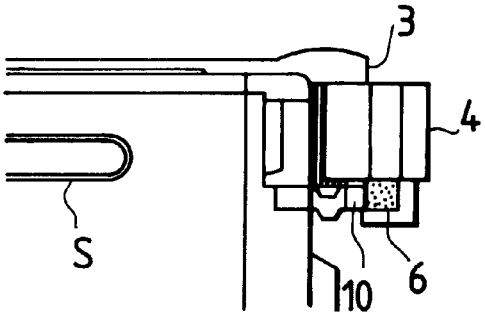

FIGS. 16A, 16B and 16C show an embodiment of expanding the cap width of the embodiment shown in FIGS. 4A and 4B over the entire front surface of the recording head having the discharge section surface 1 of the recording head.

FIG. 17 is an embodiment free from the members 7 of the embodiment of FIGS. 16A, 16B and 16C, where such a size as this requires no such a structure as to assure the positioning accuracy, and a stable fixing state can be simply obtained by fixing the cap to the recording head.

FIG. 18 shows a recording head with a cap member, where the sealing tape 3 is integrated with the surface of elastomer on the cap and a method for the preservation of the record head. This structure is effective for the recording head proper after taken out of a carriage having a structure as shown in FIG. 8.

The present invention technically relating to the foregoing embodiments will be further explained below, referring to the other drawings.

Figure 9:
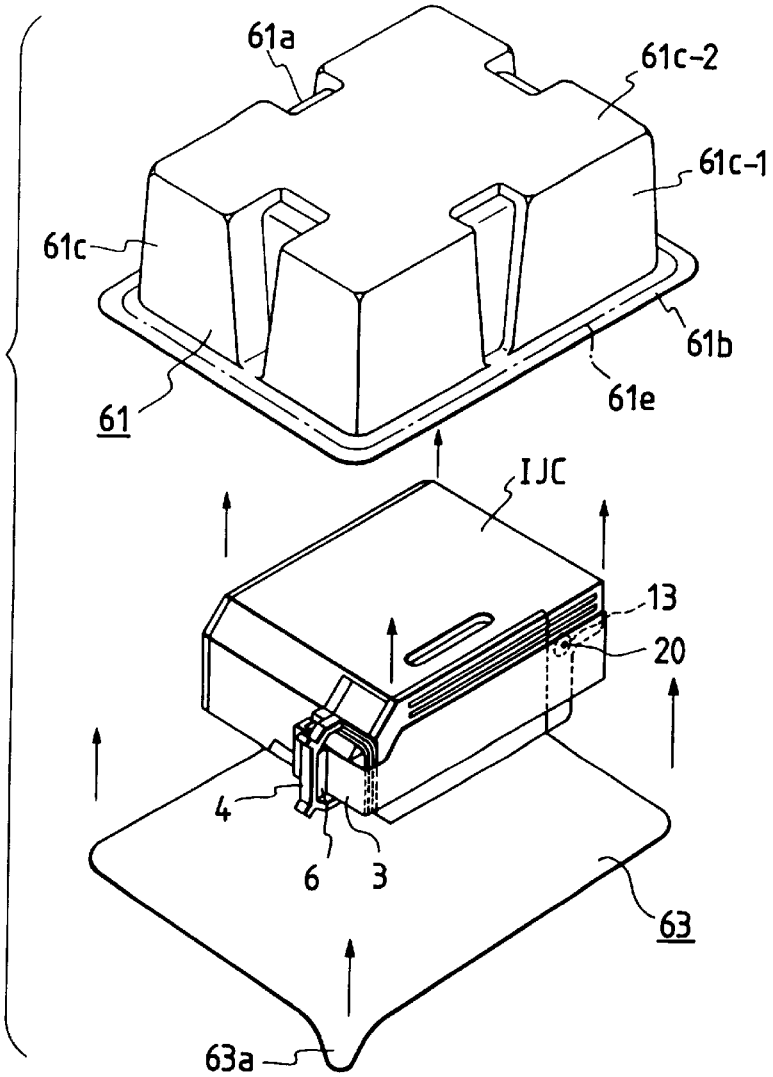
FIG. 9 is an expanded perspective view showing an example of an encasing container (packaging container) for the present ink jet cartridge.
Figure 10:
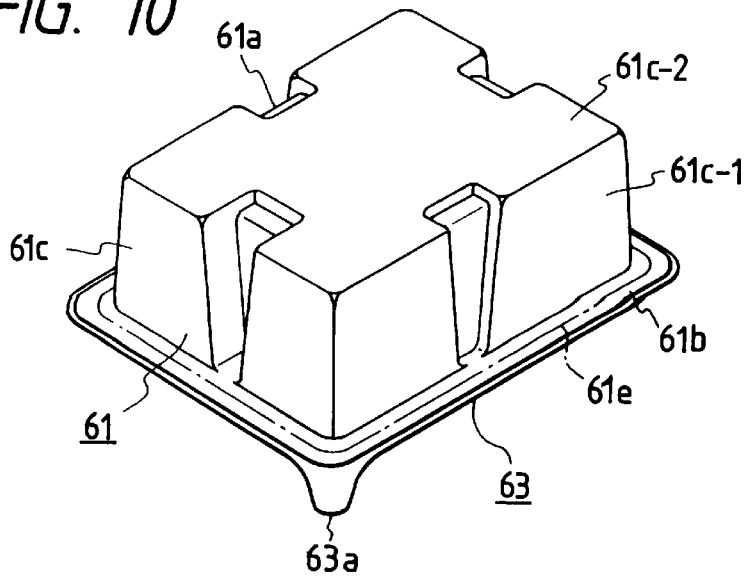
FIG. 10 is a perspective view showing one example of an encasing container (packaging container) for the present ink jet cartridge after assembling
Figure 19A:
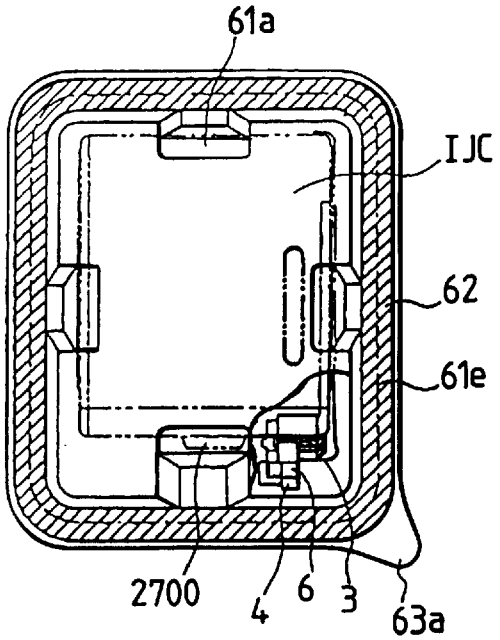
FIGS. 19A, 19B and 19C are a plan view, a front view and a right side view showing one example of the present encasing container.
Figure 19C:
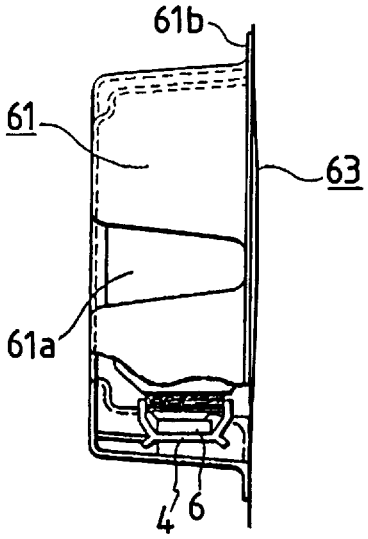
Figure 19B:
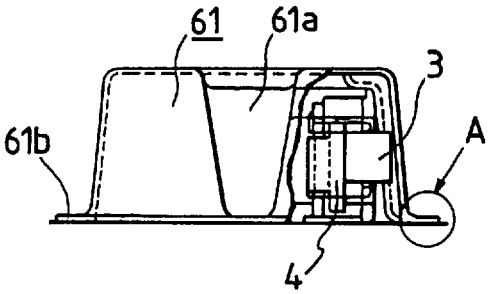
Figure 19D:
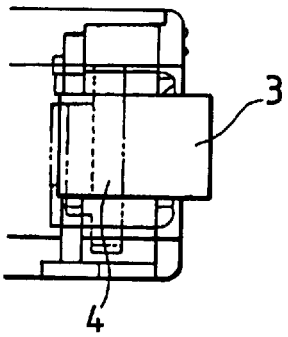
FIG. 19D is a partial enlarged view showing the encased state of the discharge section of an ink cartridge.
Figure 19E:
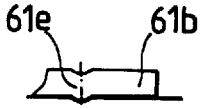
FIG. 19E a partial enlarged view showing the flange section of an encasing container proper, respectively.

FIG. 9 is an expanded perspective view of one example of an encasing container (packaging container) of the present ink jet cartridge, and FIG. 10 is a perspective view thereof after assembling. FIGS. 19A, 19B and 19C are a plan view, a front view, and a right side view of one example of the present encasing container, and FIG. 19D is a partial enlarged view showing the encased state of the discharge nozzle section of the ink jet cartridge, and FIG. 19E is a partial enlarged view showing the flange section of the encasing container body, respectively. The encasing container comprises a container body 61 and a cover member 63, as integrated together by bonding, and is used as a packaging container.

The container body 61 is provided with wall sections 61*c* kept in non-contact state with the ink jet cartridge IJC as contents, concave sections 61*a* projected from the wall sections 61*c* towards the contents-encasing region to support the encased ink jet cartridge IJC and position the IJC, and a flange section 61*b* for integrating the cover member 63 by bonding. Discharge opening of the ink jet cartridge IJC is kept in non-contact-state with the wall part in the encasing space. As shown in these drawings, better protection of the discharge opening can be assured by making the depth of the concave section locating towards the discharge opening larger among the four concave sections 61*a* projected into the encasing space, to locate the tip end of the concave section deeper in the encasing space, with this structure, insertion of the ink jet cartridge in a reversed direction by a user can be prevented at the same time. That is, the called misinsertion can be prevented.

The wall sections 61*c* must have a particularly sufficient strength and is formed in such a thickness from such materials as to give a sufficient strength. The thickness of the wall sections 61*c* can be properly selected in view of the kind of the constituent materials, and is, for example, 0.1 mm or more, preferably 0.3 mm or more, more preferably 0.5 mm or more, and its upper limit is, for example, 1.2 mm.

On the other hand, it is preferable that the concave sections 61*a* have a cushioning property of buffering or absorbing impacts to protect the contents. That is, when the concave sections 61*a* are formed so as to have a strength and a rigidity at similar levels to those of the wall sections 61*c,* impacts on the wall sections 61*c* are more readily transferred directly onto the contents, resulting in a possible damaging of the contents. Thus, it is desirable from these viewpoints to form the concave sections 61*a* with a relatively small thickness and same elasticity. The thickness of the concave sections 61*a* can be properly selected in view of the kind of the constituent material, and is, for example, 0.8 mm or less, preferably 0.6 mm or less, more preferably 0.4 mm or less, and the lower limit is, for example, 0.05 mm.

As constituent materials for the container 61, various resin can be used. For example, the container body 61 can be made from resin by integrated molding, because the integrated molding is preferable from the viewpoints of processability and production cost.

For the preparation of container body 61 by integrate molding, injection molding, vacuum molding, etc. can be utilized for various resins. Above all, injection molding of acrylonitrile-butadiene-styrene copolymer resin (ABS resin), polystyrene, polypropylene, polyethylene, polyethylene terephthalate, etc. is preferable from the viewpoints of easy adjustment of the thickness of wall sections 61*c* and concave sections 61*a,* relatively low cost and easy endowment of desired characteristics to the respective parts.

By providing a flange section at the bottom end of the container body 61, bonding of the container body 61 to a bottom plate 63 can be simply and securely carried out. The flange part can be molded together with other parts when the container body 61 is integrally molded. The thickness of the flange part 61*b* can be approximately equal to that of the wall sections 61*c.* It is preferable to provide a rib 61*e* along the bonding region 62 between the container body 61 and the cover member 63 to assure reinforcing. The rib 61*e* is provided as projected towards the cover member 63, in FIGS. 19A, 19B, 19C, 19D and 19E, but may be projected in a reversed direction. However, the former projection is preferable, because the bonding of the container body 61 to the cover member 63 can be more securely carried out by virtue of the projected rib. The corners at the elevation parts of the concave sections 61*a* and the wall sections 61*c* are preferably curved as shown in the drawings to obtain a better shock cushioning. The larger the radius of curvatures of the curved parts, the better. The radius of curvature can be properly selected in view of the size of the concave sections 61*a,* and is, for example, 2 mm or more, preferably 3 mm or more, more preferably 5 mm or more.

The shape of the concave sections 61*a* is so selected that the protection and positioning of the ink jet cartridge IJC in the packaging container can be effectively made. In the embodiment shown in the drawings, the ink jet cartridge IJC is supported by four concave sections 61*a,* and this form is most suitable from the viewpoints of protection and positioning of the ink jet cartridge IJC. Number of the concave sections 61*a* can be selected as desired.

When the clearance between the concave sections 61*a* and the supported parts of the ink jet cartridge is too large, the ink jet cartridge encased in the packaging container will be preferably rickety and slipped out, whereas when it is too small, the fittness of the ink jet cartridge to the container body 61 will be poor and impacts is more transferrable to the ink jet cartridge from the wall sections 61*c.* The clearance must be properly selected in view of the structure of the concave sections 61*a* and matching of the concave parts 61*a* to the ink jet cartridge, and is, for example, 0.5 to 3 mm, preferably 0.5 to 2 mm.

Materials and thickness of the cover member 63 are selected in view of the weight, strength, etc. of the ink jet cartridge. For the cover member 63, for example, resin or metallic films, sheets or plates or laminates containing at least one of these films, sheets and plates are used. When the laminate is used as the cover member 63, and when the surface layer at the unbonded side of the cover member 63 to the container body 61 (the surface layer will be hereinafter referred to as "outermost layer") is paper, the paper may undergo curling deformation due to a change in the surrounding circumstance, particularly a change in the humidity by moisture release or absorption, and thus it is preferable to provide on the outermost layer a moisture-preventing layer of, for example, aluminum, polyvinylidene chloride or propylene. In that case, the bonding part 62 between the container body 61 and the cover member 63 can be prevented from acting of a force in the peeling direction due to the curling deformation. As a moisture-preventing layer, a polypropylene layer having a thickness of 15 to 100 $\mu$m is most preferable from the viewpoint of cost and strength.

To bond the container body 61 containing the ink jet cartridge IJC to the cover member 63 various bonding procedures can be utilized. For example, the container body 61 and the cover member 63 are made from the same kind of resin material and bonded to each other by-heat fusion or ultrasonic welding. An easy-to-peel layer is provided at least in the region necessary for bonding on the bottom plate 63 and the container body 61 and the cover member 63 can be bonded to each other by the heat fusion or ultrasonic welding. Since the cover member 63 can be readily removed from the container body 61 at the depacking when the easy-to-peel layer is utilized, a fear of damaging the ink jet cartridge is much reduced as an advantage. Thus, use of the easy-to-peel layer is preferable from the viewpoint of the moisture prevention, humidity maintenance of the contents and easy depacking. As the easy-to-peel layer, for example, various hot melt-based, polyethylene-based and Evar-based layers, etc. can be utilized.

It is preferable in view of handling that provide a pickup member 63*a* on the cover member 63. The pickup member 63*a* is to be used for releasing the bonding to the container body 61, and is provided at a position near the discharge nozzle of the ink jet cartridge, as shown in FIG. 1, etc., but it is more preferable to provide it at a position as far from the discharge nozzle as possible, because when the cover member 63 is released from the container body 61 by picking up the pickup member 63*a,* a possible touching of slipped fingers to the discharge nozzle which must be particularly protected among the ink jet cartridge members, is avoided.

By selecting the constituent material of the present packaging container, a function of maintaining the humidity atmosphere of the contents, that is, preventing moisture or evaporation of water from the content to the outside can be obtained.

That is, by using, for example, resins coated with a polyvinylidene chloride layer or an aluminum layer, or materials having a resistance to moisture permeation, such as polypropylene, etc. as the constituent material for the container body 61, the above-mentioned function of maintaining the humidity atmosphere can be obtained. From the viewpoints of production cost, moldability, processability, etc., polypropylene is preferable.

By using a resin film, sheet or plate, or paper sheet or plate coated with a polyvinylidene chloride or an aluminum layer or polypropylene having a resistance to moisture permation as the constituent material for the cover member 63 likewise, a good function of maintaining a humidity atmosphere can be obtained. In order to improve both of the inpact cushioning and the function of maintaining the humidity atmosphere, it is preferable that the cover member has a layer for tightly sealed bonding to the container proper (for example an easy-to-peel layer) and a polypropylene layer on the unbonded surface (outermost surface) for curling prevention. Particularly a laminate having an aluminum layer and a polyprolylene layer as the outermost layer at the unbonded side is preferable from the viewpoints of cost, impact cushioning and function of maintaining the humidity atmosphere.

When the container body 61 is formed from polypropylene by vacuum molding, it is preferable to mold the elevation sections of the concave parts 61*a* and the wall parts 61*c* as curved sections, as mentioned above, because the container body 61 can have a better impact cushioning and a better function of maintaining the humidity atmosphere.

When all other sections than the ceiling section 61*c*-2 of a raw material sheet are stretched in vacuum in the direction of the ceiling 61*c*-2 to the bottom (flange 61*b*) of the container proper 61 to mold the concave section 61*a* and side surfaces 61*c*-1 of the wall sections 61*c* and curved section by male-type molding, each section can have a more uniform thickness without pinholes and thus can have a higher resistance to the moisture permeation.

When no curved sections are provided on the container body at the vacuum molding, the boundaries between the wall sections and the concave sections or between the wall sections and the flange section of the container proper are formed as corner parts having a small thickness, and thus pinholes are readily formed on the container proper is readily damaged when fallen, or the corner sections have a low resistance to the moisture permeation. By molding the boundaries as curved sections, formation of sections having a small thickness can be more effectively prevented, and a better resistance to the moisture permeation can be more uniformly obtained throughout the container proper, and a stronger outer periphery to a falling impact can be obtained.

By selecting a transparent or semi-transparent material for the container body 61 and (or the bottom plate 63, the ink jet cartridge 62 in a packaged state can be seen through.

By providing a sealing member 3 for covering (sealing) the discharge section surface of an ink jet cartridge as shown in FIG. 1, evaporation of ink through the discharge nozzle can be kept to minimum, and thus the humidity can be properly maintained in the encasing space and consequently the curling deformation of the cover member can be prevented. The supply path from the ink to the discharge nozzle can be kept in a good state.

In the present invention, the sealing member 3 is not limited only to the tape form, but a tape from is most preferable form the viewpoints of easy handling (for example, simple peeling), good maintenance of a tight sealing of discharge opening, so small thickness as not to give any influence to the size of an ink jet cartridge, and formation at a lower cost. As a material for the sealing member 3, for example, PP, PE, PVC and polyethylene terephthalate (PET) can be used.

The adhesive layer is provided at the bonding side of the sealing member 3 to the head, and also at the position for tightly sealing the atmosphere-communicating opening.

As shown in FIG. 1, a press member 4 for pressing the sealing member 3 to the ink jet cartridge IJC is provided on the ink jet cartridge. According to a preferable embodiment of the press member 4, a cap member provided with an ink absorber 6 at the position corresponding to the discharge opening can be mentioned.

By providing such a press member 4, touching of the discharge opening by user's fingers can be prevented when the ink jet cartridge IJC is taken out of the encasing container, and thus it is preferable from the viewpoint of protection of discharge opening section, which must be particularly protected in the ink jet cartridge, to provide the press member 4. It is preferable to provide the press member 4 so as not to move in contact with the wall parts 61*c* of the encasing container 61, even if the ink jet cartridge moves in the encasing container within the clearance.

Figure 20:
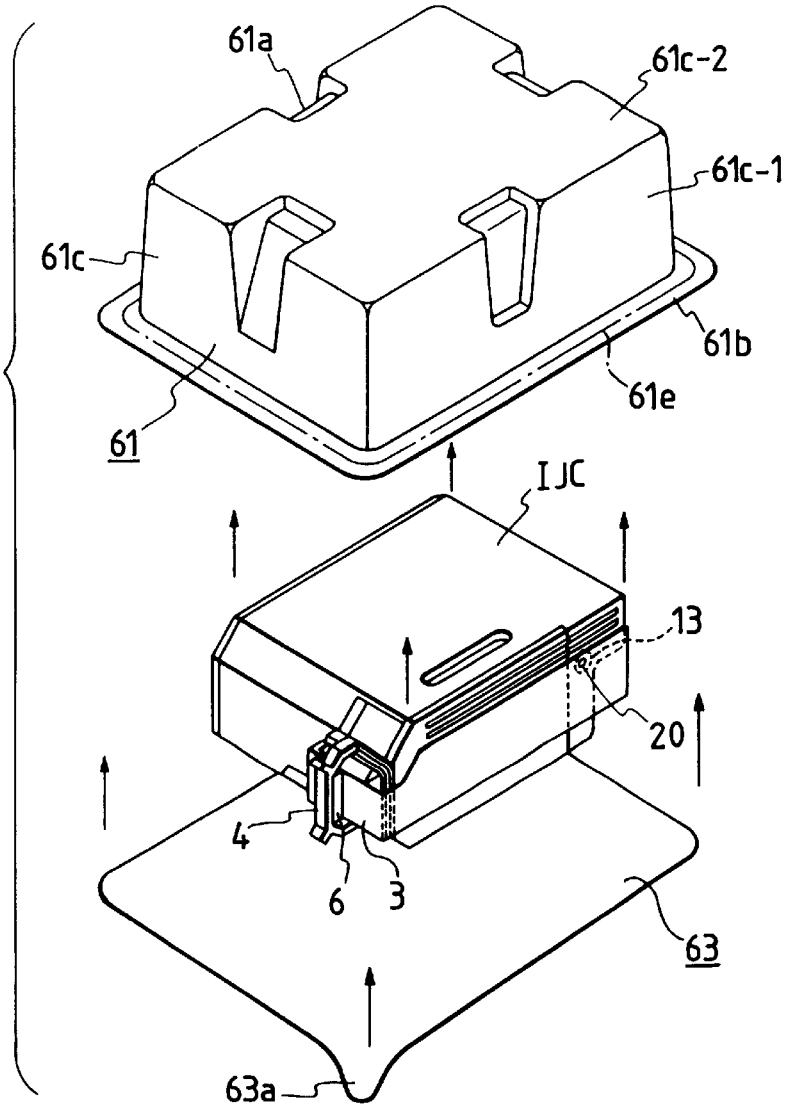
FIG. 20 is an expanded perspective view of still further embodiment of a container for encasing or packaging an ink jet cartridge of the present invention.
Figure 21:
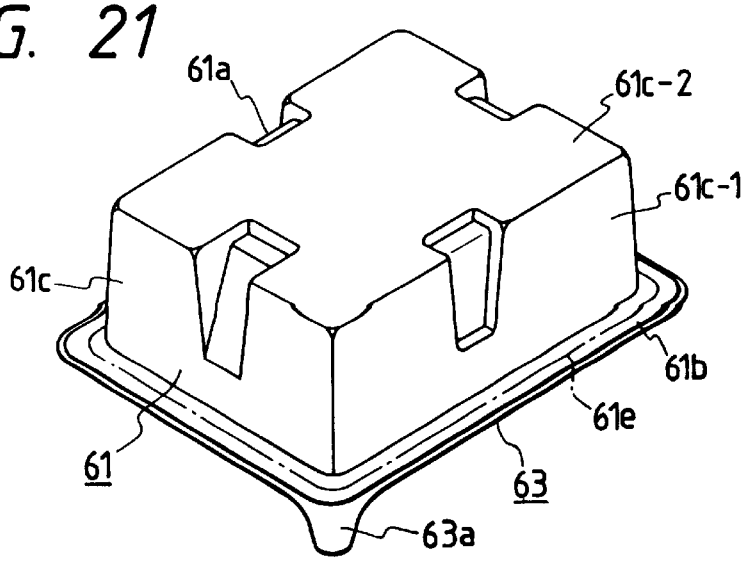
FIG. 21 is a perspective view of still further embodiment of a container for encasing or packaging an ink jet cartridge of the present invention.
Figure 22E:
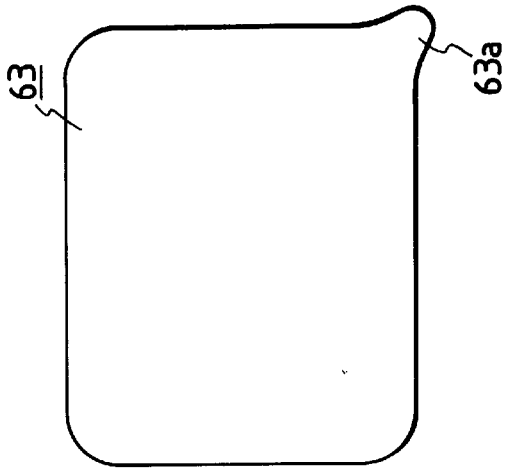
FIGS. 22A, 22B, 22C, 22D, 22E and 22F are a left side view, a plan view, a front view, a right side view, a bottom side view of still further embodiment of a container for the encasing of the present invention, and a partially enlarged view of the flange part of the container proper for the encasing, respectively.
Figure 22A:
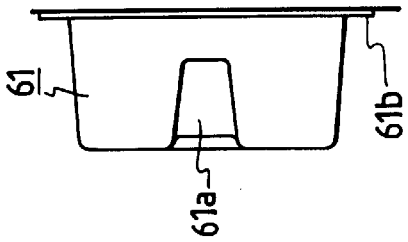
Figure 22F:
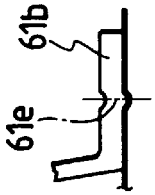
Figure 22B:
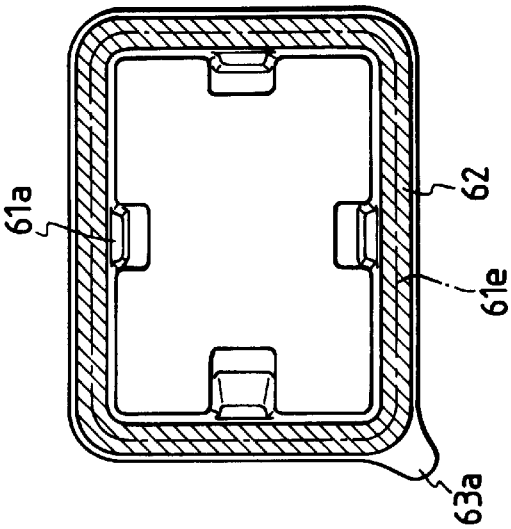
Figure 22C:
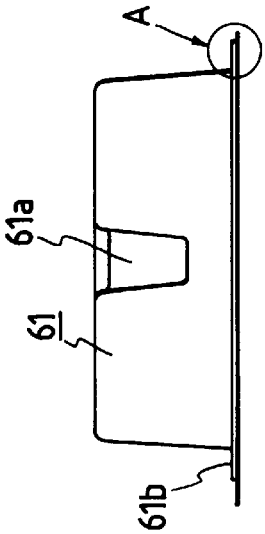
Figure 22D:
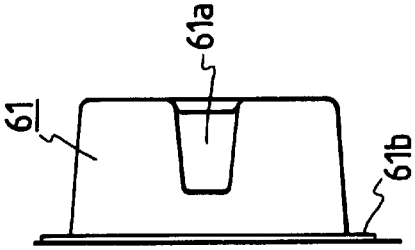
Figure 23A:
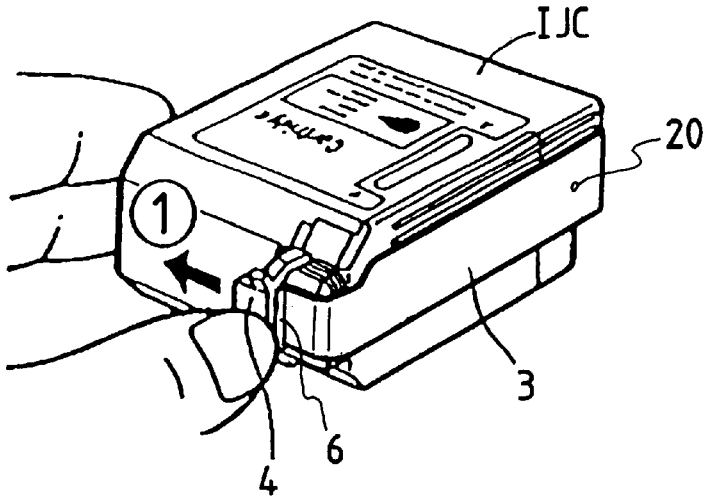
FIGS. 23A, 23B and 23C are views explaining operations of the present invention when a recording head embodying the structure of the present invention is brought into a usable state.
Figure 23B:
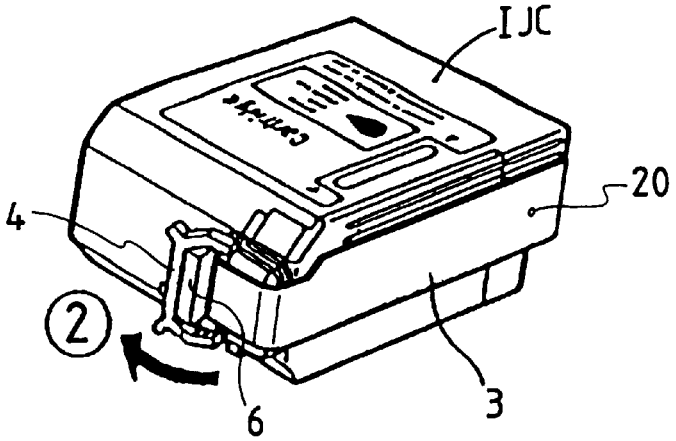
Figure 23C:
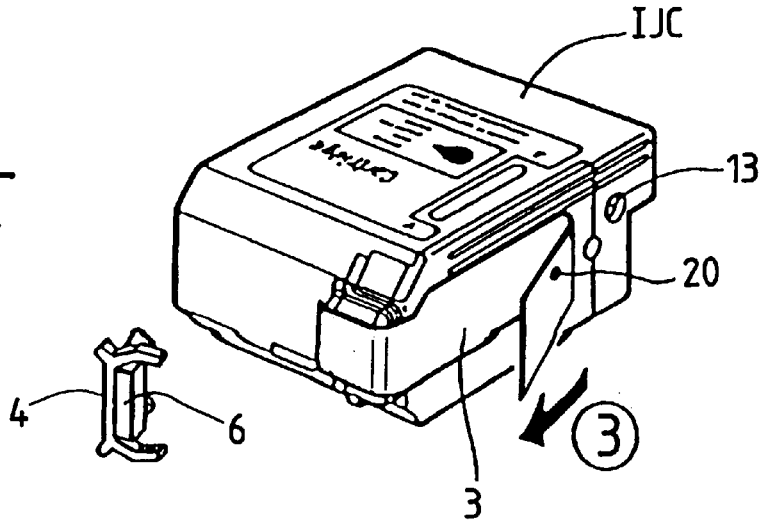

FIG. 20 is an expanded perspective view of an encasing container (packaging container) for an ink jet cartridge according to another embodiment of the present invention. FIG. 21 is a perspective view of the encasing container of FIG. 20 after the assembling. FIGS. 22A, 22B, 22C, 22D, 22E and 22F are a left side view, a plan view, a front view, a side view, a bottom view and a partially enlarged view showing the flange section of an encasing container proper, respectively, of the encasing container according to another embodiment of the present invention. (FIG. 22C is different from FIG. 19*b* in the side taken as "front view".)

EXAMPLES 1 TO 6 OF SEALING TAPE

Sealing tapes 3 were prepared by applying the following acrylic-based adhesive to a substrate comprising 12 μm-thick PET+3 μm-thick colored adhesive layer+12 μm-thick PET. The acrylic-based adhesive-applied surface of the substrate was subjected to a corona discharge treatment to improve the tight adhesion.

Example 1

Sealing tape A

| | |
|---|---|
| Butyl acrylate | 80 parts by weight |
| acrylonitrile | 10 parts by weight |
| 2-hydroxyethyl acrylate | 10 parts by weight |

These components were subjected to solution polymerization in a mixed solvent of toluene and butyl acetate (50:50 by volume) in the presence of benzoyl peroxide as a catalyst at 85° C. for 8 hours, whereby polymers having a weight average molecular weight of 300,000 were obtained. To remove monomers and low polymers from the resulting polymers, polymers were precipitated from ethanol and the monomers and the low polymers were removed with the solvent, and the residues were dried. Then, the resulting polymers were dissolved in a mixed solvent of toluene and ethyl acetate (50:50 by volume), and 10.1 g of dicyclohexylmethane diisocyanate was added based on 100 parts by weight of the polymers to prepare a coating solution. The coating solution was applied onto the substrate to a thickness of 25 μm as solid matters and heated at 80° C. for 10 minutes and further aged at the ordinary temperature for one week to obtain a sealing tape A.

Example 2

Sealing tape B

Sealing tape B was prepared in the same manner as in Example 1 except that 20.2 g of dicyclohexylmethane diisocyanate was used.

Example 3

Sealing tape C

Sealing tape C was prepared in the same manner as in Example 1 except that 2.5 g of dicyclohexylmethane diisocyanate was used.

Example 4

Sealing tape D

| | |
|---|---|
| Butyl acrylate | 70 parts by weight |
| Ethyl acrylate | 10 parts by weight |
| Acrylamide | 10 parts by weight |
| 2-hydroxyethyl methacrylate | 10 parts by weight |

The foregoing components was dissolved in ethyl acetate and subjected to reaction at 60° C. for 12 hours, using benzoyl peroxide as a catalyst. The resulting polymers were precipitated from methanol and the precipitates were dried and reprecipitated from ethyl acetate/methanol to purify the polymers. 4.0 g of 1-methylcyclohexane-2, 4-diisocyanate was added based on 100 parts by weight of the polymers to prepare a coating solution. Then, the coating solution was applied to the same substrate as used in Example 1 to a thickness of 30 μm as solid matters, heated at 80° C. for 10 minutes and aged at the ordinary temperature for one week to obtain a sealing tape D.

Example 5

Sealing tape E

| | |
|---|---|
| Butyl acrylate | 80 parts by weight |
| 2-ethylhexyl acrylate | 10 parts by weight |
| 2-hydroxyethyl acrylate | 10 parts by weight |

The foregoing components were dissolved in ethyl acetate and subjected to reaction at 60° C. for 12 hours, using benzoyl peroxide as a catalyst. The resulting polymers were precipitated from methanol, and the precipitates were dried and reprecipitated from ethyl acetate/methanol to purify the polymers. Then, 8.0 g of 1-methylcyclohexane-2, 4-diisocyanate was added based on 100 parts by weight of the polymers to prepare a coating solution. The coating solution was applied to the same substrates as used in Example 1 to a thickness of 20 μm as solid matters, heated at 80° C. for 10 minutes and aged at the ordinary temperature for one week to obtain a sealing tape E.

Example 6

Sealing tape F

| | |
|---|---|
| Butyl acrylate | 70 parts by weight |
| Octyl acrylate | 10 parts by weight |
| Acrylonitrile | 12 parts by weight |
| 2-hydroxyethyl acrylate | 8 parts by weight |

The foregoing components were dissolved in ethyl acetate and subjected to reaction at 60° C. for 10 hours, using benzoyl peroxide as a catalyst. The resulting polymers were precipitated from methanol, and the precipitates were dried and reprecipitated from ethyl acetate/methanol to purify the polymers. 8.6 g of isophorone diisocyanate was added based on 100 parts by weight of the polymers to prepare a coating solution. Then, the coating solution was applied to the same substrate was used in Example 1 to a thickness of 30 μm as solid matters, and heated at 80° C. for 10 minutes and further aged at the ordinary temperature for one week to obtain a sealing tape F.

To make the effect of the present invention clear, the following sealing tapes G and H were prepared.

Comparative Example 1

Sealing tape G

| | |
|---|---|
| Butyl acrylate | 50 parts by weight |
| Ethyl acrylate | 30 parts by weight |
| Acrylonitrile | 5 parts by weight |
| 2-hydroxymethacrylate | 15 parts by weight |

The foregoing components were subjected to solution polymerization in a mixed solvent of toluene and butyl acetate (50:50) in the presence of benzoyl peroxide as a catalyst at 85° C. for 5 hours to obtain polymers having a weight average molecular weight of 150,000. To remove the low polymers and monomers from the resulting polymers, the polymers were precipitated from methanol to remove the low polymers and monomers together with the solvent. The precipitates were dried and redissolved in a mixed solvent of toluene and butyl acetate (50:50 by volume). 12.0 parts by weight of xylene diisocyanate was added based on 100 parts by weight of the polymers to prepare a coating solution.

Then, the coating solution was applied to the same substrate in the same manner as used in Example 1 (sealing tape A) to a thickness of 20 μm as solid, dried at 80° C. for 10 minutes and aged at the ordinary temperature for 10 days to obtain comparative sealing tapes G.

Comparative Example 2

Sealing tape H

| | |
|---|---|
| Butyl acrylate | 50 parts by weight |
| 2-ethylhexyl acrylate | 40 parts by weight |
| Ethyl acrylate | 10 parts by weight |

The foregoing components were dissolved in acetone with stirring and subjected to solution polymerization at 60° C. for 5 hours to obtain polymers of a weight average molecular weight of 800,000. Then, 50 parts by weight of oil-soluble phenol resin and 50 parts by weight of butyl acrylate were added to the polymers and subjected to high speed stirring for 8 hours to obtain a coating solution. Then, the coating solution was applied to the same substrate as used in Example 1 (sealing tape A) to a thickness of 25 μm as solid, dried at the ordinary temperature and aged for 10 days to obtain a comparative sealing tape H.

Evaluation procedure

1. Adhesiveness (evaluation for reference)

According to the above-mentioned procedure for determining the adhesiveness, a stainless steel (SUS304) test plate was used for the determination. Measurements are given as an adhesiveness (5/25) in Table 1.

2. Test by ink jet head

This test is to show the effects of an ink jet recording head and a recording apparatus using the ink jet recording head.

Ink jet heads each having 64 openings at a opening distance of 16 openings/mm, as shown in FIG. 9, were filled with an ink having the following composition and sealing tapes A to F of Examples 1 to 4 and sealing tapes G and H of Comparative Examples 1 and 2 were pasted on the opening surface and the atmosphere-communicating opening in the form as shown in FIG. 9 and a small opening having a cross-section of about 0.03 mm was made with a needle. Each tape was used for 10 head and the number of heads with peeled sealing tapes from the atmosphere-communicating opening were counted and shown in Table 1. Then the heads were each placed in the respective containers as shown in FIG. 9 and preserved at 60° C. for three months, and then the sealing tapes were taken away, and image were printed. It's evaluation is shown in Table 1.

Ink composition

| | |
|---|---|
| C.I. Food Black 2 | 2 parts by weight |
| Glycerine | 10 parts by weight |
| Urea | 5 parts by weight |
| Ethanol | 5 parts by weight |
| Water | 78 parts by weight |

The results are summarized in Table 1

TABLE 1

| Sealing Tape | 1 Adhesiveness (g/mm) | 2(a) Inorganic Impurity | 2(a) Organic Impurity | 3(a) Discharge nozzle State | 3(b) Image |
|---|---|---|---|---|---|
| Example 1 | 150 | none | none | excellent | good |
| Example 2 | 210 | none | none | excellent | good |
| Example 3 | 340 | none | none | excellent | good |
| Example 4 | 85 | none | none | good | good |
| Comparative Example 1 | 60 | none | yes | seriously poor | Some image failure observed due to non-discharge |
| Comparative Example 2 | 650 | Sn, Ca | yes | poor | Some image failure observed due to non-discharge |

The effect of the present invention is clear from Table 1.

Recording Head Example 1

A container body having a structure shown in FIG. 9 was prepared from a polypropylene sheet having a thickness of 1 mm by male-type vacuum molding for drawing all other parts than the ceiling section 61*c*-1 towards the bottom section with the following dimension:

Minimum thickness: 0.2 mm

Radius of curvature at the corners: 3 mm

On the other hand, a cover member 63 was prepared by laminating a polypropylene layer (thickness: 30 μm), a polyethylene terephthalate layer (thickness: 12 μm), an aluminum layer (thickness: 9 μm) and a polyethylene-based-easy-to-peel layer (thickness: 30 μm) in the direction from the bonding side to the container body outwards in this order.

An ink jet cartridge IJC containing an ink tank for storing an ink, pasted with a sealing tape of any one of the above-mentioned A to H thereon and provided with a small opening having a cross-section of about 0.03 mm through the tape, made by a needle, and also provided with a cap member with an ink absorber 6 as a press member 4 for pressing the protective tape was encased in the container proper 61. Then the cover member 63 was placed on the bottom of the container itself and the flange 61*b* and the cover member 63 were bonded to each other by an ultrasonic welder.

The thus obtained single packages and their assembles were subjected to falling test from a predetermined level to inspect the protection state of the packaged ink jet cartridges. Neither damages of the in jet cartridges nor leakage was found at all.

Furthermore, the thus obtained packages was left standing under predetermined circumstance conditions for predetermined time and then the amount of evaporated water from the ink filled in the ink jet cartridge was determined by measuring the weight of the ink jet cartridge. A slight decrease in the weight was found.

Still furthermore, no deformation such as curling, etc. of the cover members was found after the standing for a predetermined time.

Recording Head Example 2

Container bodies were made in the same manner as in Recording Head Example 1, except that a polyvinyl chloride sheet coated with polyvinylidene chloride to a thickness 30 μm was used.

Falling test of the thus obtained packages was carried out in the same manner as in Recording Head Example 1, and it was found that the packaged ink, jet cartridges were not damaged and no ink leakage occured.

An amount of water evaporated from the ink filled in the packaged ink jet cartridges was determined in the same manner as in Recording Head Example 1. It was found that it was as slight as in Recording Head Example 1 and there was no deformation such as curling, etc. of the cover members at all.

Recording Head Example 3

Container bodies were made in the same manner as in Recording Head Example 1, except that the radius of curvature R was changed to 1 mm at the curved parts, and packaged ink jet cartridges were subjected to the falling test and determinations of the amount of evaporated water from the ink. Minimum thickness of the resulting containers body was 0.05 mm.

In the falling test light dents were observed on the parts of the package container bodies, and no abnormal state including an ink leakage was observed on the packaged ink jet cartridges.

Furthermore, an amount of evaporated water from the ink filled in the ink jet cartridges was slight and no deformation of the cover members was found.

Recording Head Example 4

Container bodies were prepared in the same manner as in Recording Head Example 1 except that all other parts than the flange section 61*b* were prepared from a polypropylene sheet by female-type molding, that is, by vacuum drawing from the part of the polypropylene sheet destined to the flange section 61*b* and the radius of curvature at the corners of the flange section 61*b* was set to 0.5 mm and that the corners of other parts to 2 mm, and were used for packaging of ink jet cartridges.

The thus obtained packages were subjected to a falling test and determination of an amount of water evaporated from the ink in the ink jet cartridges.

In the falling test, no abnormal state was found in the packaged ink jet cartridges.

Heating to 50° C. and successive falling tests of the recording heads of Recording Head Example 1 were carried out in the packaged state, and neither damages nor ink leakage was found at all. It was found that the present invention was effective.

The present invention has a distinguished effect particularly in a bubble jet system recording head and recording apparatus proposed by Canon K.K. among the ink jet recording systems. It is preferable to use the typical structure and principle as disclosed in U.S. Pat. Nos. 4,723,129 and 4,740,796. This type can be applied to any of the so called on-demand type and continuous type. Particularly in case of the non-demand type, at least one driving signal, which gives a rapid temperature elevation over the nuclear boiling in accordance to the recorded information can be applied to an electro-thermal converter provided in a sheet or liquid path in which a liquid (ink) is contained, thereby generating heat energy in the electro-thermal converter to cause nuclear boiling on the thermally working surface of the recording head. As a result, bubbles can be effectively formed in the liquid (ink) as a response to each driving signal. By growth or shrinkage of the bubbles, the liquid (ink) can be discharged through the discharge opening to form at least one droplet. In case that the driving signal is in a pulse form, appropriate growth or shrinkage of bubbles can be made instantaneously to discharge the liquid (ink) with a particularly good response. This is more preferable. The driving signals in the pulse form disclosed in U.S. Pat. Nos. 4,463,359 and 4,345,262 are suitable. Under the conditions disclosed in U.S. Pat. No. 4,313,324 for the temperature increase rate on the thermally working surface, much better recording can be carried out.

Besides the combined structures of discharge opening a liquid path and an electro-thermal converter (linear liquid path or right angle liquid path) disclosed in the above-mentioned specifications as a recording head structure, the present invention includes the structures disclosed in U.S. Pat. Nos. 4,558,333 and 4,459,600 on arrangement of the thermally working section in a bent region. Furthermore, the present invention is also effective for structures disclosed in Japanese Patent Application Laid-open No. 59-123670 on the structure of a common slit as discharge section of a plurality of electro-thermal converters, or in Japanese Patent Application Laid-open No. 59-138461 on the structure of an opening for absorbing a thermal energy pressure wave as a discharge nozzle.

Furthermore, in case of a full-line type, recording head having a length corresponding to the maximum recording medium width which the recording apparatus can record, any of the structure satisfying the length through a combination of a plurality of recording heads, and the structure as one integrally formed recording head, as disclosed in the above-mentioned specifications, can be used in the present invention. The above-mentioned effect can be more enhanced in the present invention.

The present invention is also effective for an exchangeable chip-type recording head capable of electrical connection to the apparatus body or ink supply from the apparatus body or a recording head of cartridge type integrally provided on the recording head itself.

It is preferable to add a regaining means, a preliminary auxiliary means, etc. for the recording head as structural elements of the recording apparatus of the present invention, because the effect of the present invention can be more stabilized. More specifically, it is effective for more stabilized recording to provide a capping means, a cleaning means, a pressurizing or absorbing means, an electro-thermal converter or a different heating element from the electro-thermal converter, or a preliminary heating means on the basis of their combination, and a preliminary discharging mode for conducting other discharge them that for recording on the recording head.

Recording mode of the recording apparatus is not only by a main color such as black, but can be by integral structuring of the recording head or a combination of a plurality of recording heads. The present invention is very effective also for a recording apparatus with a plurality of different colors or at least one of full colors by color mixing.

The present sealing structure can securely protect at a low cost the ink jet cartridge itself and the sealing state by virtue of the above-mentioned packaging container from the vibrations during the transportation, etc. or falling impacts. That is, the present packaging container is provided with concave sections arranged in accordance to the shape of an ink jet cartridge and supports the contents at an appropriate distance for preventing direct contact of the ink jet cartridge with the wall sections of the packaging container body, and thus can effectively fix the position of the ink jet cartridge in the packaging container and protect the contents against the impacts externally exerted on the wall sections of the packaging container.

According to the packaging by the present packaging container, an increase in the occupied space by the packaging can be kept smaller. That is, the space saving is higher and warehouse space and transportation space can be also saved, resulting in cost reduction in the preservation and transportation.

Furthermore, the present packaging container has a function of maintaining the humidity atmosphere in a packaged state of an ink jet cartridge and thus can give packaging with good protection of an ink jet cartridge and good maintenance of the humidity atmosphere.

Still furthermore, provision of a sealing member for covering(sealing) the discharge opening on the discharge opening surface of an ink jet cartridge can suppress evaporation of ink through the discharge opening to a minimum, and thus can appropriately maintain the humidity in the encasing space, prevent curling deformation of the cover member and keep the ink supply path from the ink tank to the discharge opening in a good state.

Still furthermore, provision of a press member for pressing the sealing member to the ink jet cartridge can prevent touching of user's fingers to the discharge opening section when the ink jet cartridge is to be removed from the encasing container, and thus is more preferable from the viewpoint of the protection of the discharge opening section.

In the present invention, problems of ink leakage from the welded parts during the transportation can be solved by controlling an internal pressure increase in the ink container when the recording head is out of the recording.

According to the present ink jet recording head, the internal pressure of the ink tank is not increased, for example, even at a high temperature expectable during the transportation by closing the discharge opening section and the atmosphere-communicating opening for the ink tank by an acrylic-based adhesive tape, thereby tightly sealing the discharge opening section, and providing a small opening on the adhesive tape at the position corresponding to the atmosphere-communicating opening. Thus, ink leakage can be prevented thereby and also ink leakage from the atmosphere-communicating opening can be prevented even when there is a gentle circulating motion in the ink, where the force of inertia works during the transportation.

Prevention of ink leakage may be obtained by considerably increasing the adhesiveness of the adhesive tape, but in that case the discharge opening will be deformed at the peeling of the adhesive tape, and also it is necessary to maintain the adhesiveness of the adhesive tape for a long time. It is difficult to design such an adhesive tape. In the present invention, on the other hand, the above-mentioned object can be attained in a simple manner, and an allowance for the adhesiveness of the adhesive tape is broad. Thus, the present invention is advantageous also from the viewpoint of cost.

In the present invention, an acrylic-based adhesive tape can stably maintain the small opening provided over the atmosphere-communicating opening to prevent any increase in the internal pressure in the ink tank, and the adhesive tape cannot be peeled off the atmosphere-communicating opening when a small opening is provided thereon. When the ink jet recording head is used, that is, when the adhesive tape is off, no recording inconveniences such as remaining adhesive on the head surface can be prevented in the present invention.

What is claimed is:

1. An ink jet head, comprising:

an ink container for storing an ink and having an outside surface;

an ink discharge section, provided on said ink container, for discharging the ink;

an ink absorbing member, provided in said ink container, for retaining the ink;

an atmosphere-communicating portion having an opening for allowing the inside of said ink container to communicate with the atmosphere; and a sealing member, provided on the outside surface of the ink container, sealing the opening of said atmosphere-communicating portion and said ink discharge section, said sealing member being removable when the ink jet head is mounted on an ink jet apparatus, and having an opening portion of an area of 0.005 to 0.05 $mm^2$ for communicating with the opening of said atmosphere-communicating portion to control the internal pressure of said ink container, said opening portion being smaller than the opening of said atmosphere-communicating portion and located in a positioning corresponding to the opening of said atmosphere-communicating portion, whereby the internal atmosphere of said ink container is exhausted when the ink jet head is not mounted on the ink jet apparatus.

2. An ink jet head according to claim 1, wherein said opening portion has a slit shape.

3. An ink jet head according to claim 1, wherein said sealing member said an adhesive, the adhesive comprising acrylate ester copolymers produced by cross-linking with an isocyanate an acrylate copolymer obtained from at least 80% by weight of a total of alkyl acrylate ester having OH groups and/or alkoxyalkyl acrylate ester having OH groups, and acrylate ester having an alkyl group or an alkoxyalkyl group of $C_4$ to $C_9$ as a side chain.

* * * * *

UNITED STATES PATENT AND TRADEMARK OFFICE

CERTIFICATE OF CORRECTION

PATENT NO. : 5,940,104

DATED : August 17, 1999

INVENTOR(S) : SEIICHIRO KARITA, ET AL.

It is certified that error appears in the above-identified patent and that said Letters Patent is hereby corrected as shown below:

COLUMN 2:

Line 25, "propose" should read --proposal--.

COLUMN 4:

Line 8,"discahrge" should read --discharge--.
Line 27, "a" should be deleted.

COLUMN 9:

Line 21, "180°." should read --180°--.

COLUMN 11:

Line 24, "positions" should read --position--.
Line 29, "shows" should read --show--.

COLUMN 13:

Line 25, "state" should read --states--.

UNITED STATES PATENT AND TRADEMARK OFFICE

CERTIFICATE OF CORRECTION

PATENT NO. : 5,940,104

DATED : August 17, 1999

INVENTOR(S) : SEIICHIRO KARITA, ET AL.

It is certified that error appears in the above-identified patent and that said Letters Patent is hereby corrected as shown below:

COLUMN 15:

Line 49, "ence" should read --ent—.
Line 58, "improve at the" should read --improved during--.

COLUMN 16:

Line 28, "a structure as" should read --structure--.
Line 35, "after taken out" should read --after being taken out--.

COLUMN 18:

Line 7, "fittness" should read --fit--.
Line 8, "is" should read --are--.

COLUMN 19:

Line 14, "both of" should read --both--.
Line 64, "tape from" should --tape form--.
Line 65, "form" should read --from--.

UNITED STATES PATENT AND TRADEMARK OFFICE

CERTIFICATE OF CORRECTION

PATENT NO. : 5,940,104

DATED : August 17, 1999

INVENTOR(S) : SEIICHIRO KARITA, ET AL.

It is certified that error appears in the above-identified patent and that said Letters Patent is hereby corrected as shown below:

COLUMN 21:

Line 21, "was" should read --were--.

COLUMN 23:

Line 7, "image" should read --images--.
Line 66, "in jet" should read --ink jet--.

COLUMN 24:

Line 1, "was" should read --were--.
Line 33, "test" should read --test,--.

COLUMN 25:

Line 11, "In" should read --In the--.
Line 58, "them" should read --than--.

UNITED STATES PATENT AND TRADEMARK OFFICE

CERTIFICATE OF CORRECTION

PATENT NO. : 5,940,104

DATED : August 17, 1999

INVENTOR(S) : SEIICHIRO KARITA, ET AL.

It is certified that error appears in the above-identified patent and that said Letters Patent is hereby corrected as shown below:

COLUMN 28:

Line 7, "positioning" should read --position--.
Line 15, "said" should read --has--.

Signed and Sealed this

Tenth Day of October, 2000

*Attest:*

Q. TODD DICKINSON

*Attesting Officer*

*Director of Patents and Trademarks*